US009852866B2

(12) United States Patent
Sangawa et al.

(10) Patent No.: US 9,852,866 B2
(45) Date of Patent: Dec. 26, 2017

(54) PANEL DEVICE

(71) Applicant: MITSUBISHI ELECTRIC CORPORATION, Chiyoda-ku, Tokyo (JP)

(72) Inventors: Takayoshi Sangawa, Tokyo (JP); Munetsugu Sakamoto, Tokyo (JP); Daijiro Kondo, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 0 days.

(21) Appl. No.: 14/907,750

(22) PCT Filed: May 30, 2014

(86) PCT No.: PCT/JP2014/064408
§ 371 (c)(1),
(2) Date: Jan. 26, 2016

(87) PCT Pub. No.: WO2015/029528
PCT Pub. Date: Mar. 5, 2015

(65) Prior Publication Data

US 2016/0189902 A1 Jun. 30, 2016

(30) Foreign Application Priority Data

Aug. 28, 2013 (JP) ..... 2013-176203

(51) Int. Cl.
*H01H 9/20* (2006.01)
*H01H 71/02* (2006.01)
(Continued)

(52) U.S. Cl.
CPC ..... *H01H 71/0264* (2013.01); *H01H 9/0207* (2013.01); *H01H 9/22* (2013.01);
(Continued)

(58) Field of Classification Search
CPC .... H01H 71/0264; H01H 9/0207; H01H 9/22; H01H 9/26; H01H 33/48; H01H 33/52; H01H 2009/0292
(Continued)

(56) References Cited

U.S. PATENT DOCUMENTS 3,171,920 A * 3/1965 Klein ..... H01H 3/264 200/330
6,423,913 B1 * 7/2002 Gupta ..... H01H 9/282 200/43.11

FOREIGN PATENT DOCUMENTS

JP 47-4427 U 9/1972
JP 51-08662 Y1 3/1976
(Continued)

OTHER PUBLICATIONS

Office Action (Notification of Reasons for Refusal) dated Sep. 13, 2016, by the Japanese Patent Office in corresponding Japanese Patent Application No. 2015-534032, and an English Translation of the Office Action. (10 pages).
(Continued)

*Primary Examiner* — Anthony R. Jimenez
(74) *Attorney, Agent, or Firm* — Buchanan Ingersoll & Rooney PC

(57) ABSTRACT

A panel device includes a protective cover that has an insertion hole for an ON/OFF knob of a molded case circuit breaker and is formed to cover an exposed live part of the molded case circuit breaker and provided with an engaging part at a predetermined portion thereof; a cover support member that openably and closably supports this protective cover; and a cover locking member that engages with the engaging part when the protective cover is closed and restricts turning of the protective cover; wherein any one of the protective cover, the cover support member and the cover locking member is movably provided in conjunction
(Continued)

with movement of the ON/OFF knob, and the engaging part and the cover locking member are engaged with each other or released from each other by the movement of the any one of those.

10 Claims, 21 Drawing Sheets

(51) Int. Cl.

| | |
|---|---|
| ***H01H 33/48*** | (2006.01) |
| ***H01H 9/02*** | (2006.01) |
| ***H01H 9/22*** | (2006.01) |
| *H01H 9/26* | (2006.01) |
| *H01H 33/52* | (2006.01) |

(52) U.S. Cl.
CPC ..... *H01H 33/48* (2013.01); *H01H 9/26* (2013.01); *H01H 33/52* (2013.01); *H01H 2009/0292* (2013.01)

(58) Field of Classification Search
USPC ..... 200/50.02, 43.01, 43.11, 43.14–43.16, 200/43.19, 43.22
See application file for complete search history.

(56) References Cited

FOREIGN PATENT DOCUMENTS

| | | | |
|---|---|---|---|
| JP | 51-38651 | U | 3/1976 |
| JP | 52-163741 | U | 12/1977 |
| JP | 61-236312 | A | 10/1986 |
| JP | 07-050127 | A | 2/1995 |

OTHER PUBLICATIONS

International Search Report (PCT/ISA/210) dated Aug. 26, 2014, by the Japanese Patent Office as the International Searching Authority for International Application No. PCT/JP2014/064408.
Office Action dated Mar. 10, 2017 issued by the Canadian Patent Office in corresponding Canadian Patent Application No. 2,922,450 (4 pages).

* cited by examiner

PANEL DEVICE

TECHNICAL FIELD

The present invention relates to panel devices, such as breaker panels and control panels, incorporating an interlocking mechanism that provides protection against electric shock from any live part in conjunction with ON/OFF movement of a molded case circuit breaker knob.

BACKGROUND ART

A device is known as a conventional breaker panel, in which protective covers of molded case circuit breakers (hereinafter referred to as breakers) are attached to an inner door in the housing side, the inner door is locked by a tool-operating knob but can be opened by releasing the tool-operating knob, and when the inner door is opened, all of the protective covers of the breakers are brought into an open state regardless of the ON/OFF state of the breakers. Moreover, a control center has been known which is configured in such a way that breakers are provided with a handle for interlocking linked with a safety door, the safety door is prohibited from opening when the breakers are in the ON state, but when in the OFF state, the safety door can be opened with the internal interlock released (see Patent document 1, for example).

PRIOR ART DOCUMENT

Patent Document

Patent document 1: Japanese laid-open Patent Publication No. S61-236312 (see pp. 2-3, FIGS. 1-4)

DISCLOSURE OF THE INVENTION

Problem to be Solved by the Invention

In a device using conventional technology as described above, the door in the housing side can be opened regardless of the ON/OFF state of the breakers, if the lock of the tool-operating knob is released; therefore, there has been a danger that live parts of the breakers in the ON state can be touched in maintenance. Moreover, the interlocking mechanism of the conventional control center as described above is configured in such a way that the door cannot be opened when the breakers are in the ON state, but can be opened with the internal interlock released when the breakers are in the OFF state; therefore, the handle for interlocking is necessary for each breaker, and some extra parts for constituting the interlock are required in the housing door side, thereby causing a problem in that the number of parts increases and its configuration also becomes complicated.

The present invention has been made to solve the foregoing problem, and aims at providing a panel device that has a simple configuration and in addition can avoid such a danger as its live parts being mistakenly touched, thereby enabling maintenance to be carried out in safe.

Means for Solving the Problem

A panel device according to the present invention comprises a protective cover that has an insertion hole for an ON/OFF knob of a molded case circuit breaker and is formed to cover an exposed live part of the molded case circuit breaker and provided with an engaging part at a predetermined portion thereof; a cover support member that openably and closably supports this protective cover; and a cover locking member that engages with the engaging part when the protective cover is closed, so as to restrict turning of the protective cover; wherein either one of the protective cover and the cover support member is movably provided in conjunction with movement of the ON/OFF knob, and the engaging part and the cover locking member are engaged with each other or released from each other by the movement of the any one of those.

Advantage of the Invention

According to the present invention, since the interlock of the protective cover provided for each molded case circuit breaker can be released one by one; therefore, the danger of mistakenly touching live parts of other breakers can be avoided, so that maintenance can be carried out in safe. In addition, any one of the protective cover, the cover support member and the cover locking member is movably provided in conjunction with the movement of the ON/OFF knob, and the engaging part and the cover locking member can be engaged with each other or released from each other by the movement of the any one of those, so that the configuration of the device becomes simple and the number of parts can be decreased.

BRIEF DESCRIPTION OF THE DRAWINGS

FIGS. 7A, 7B, and 7C are views for explaining in detail the essential part of the interlocking mechanism shown in FIGS. 6A, 6B, and 6C;

BEST MODE FOR CARRYING OUT THE INVENTION

Embodiment 1

Figure 1A:
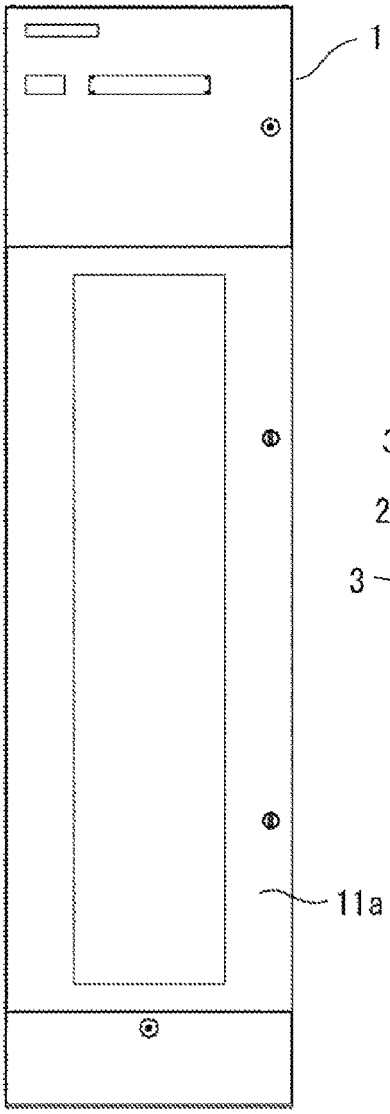
FIGS. 1A and 1B are views showing the entire configuration of a panel device according to Embodiment 1 of the present invention.
Figure 1B:
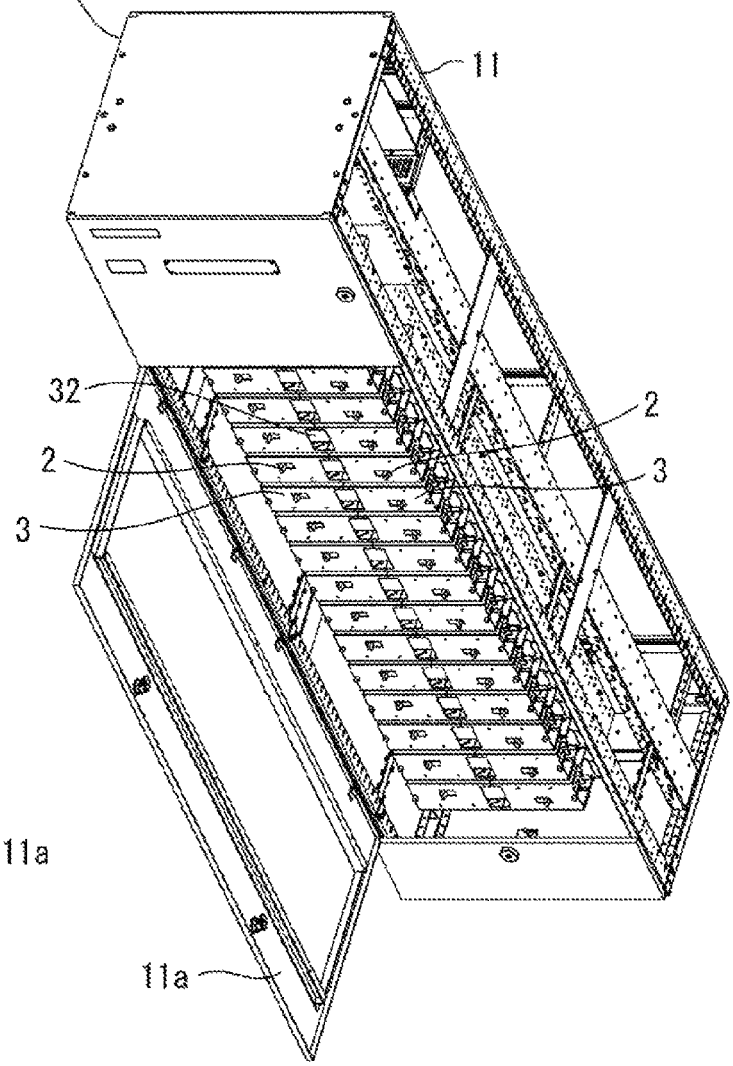
Figure 2A:
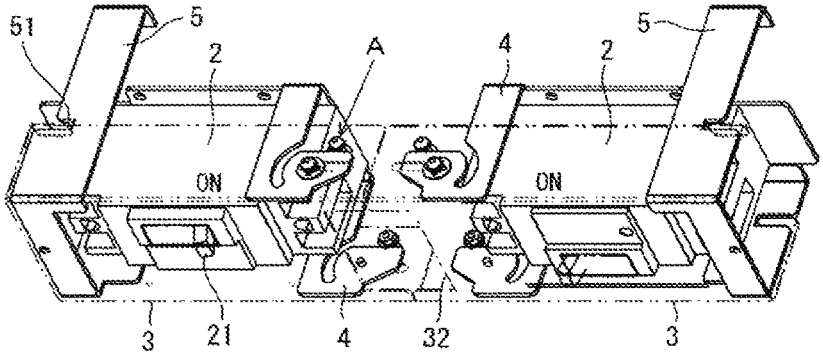
FIGS. 2A, 2B, and 2C are views for explaining an interlocking mechanism of a protective cover of the panel device according to Embodiment 1 of the present invention.
Figure 2B:
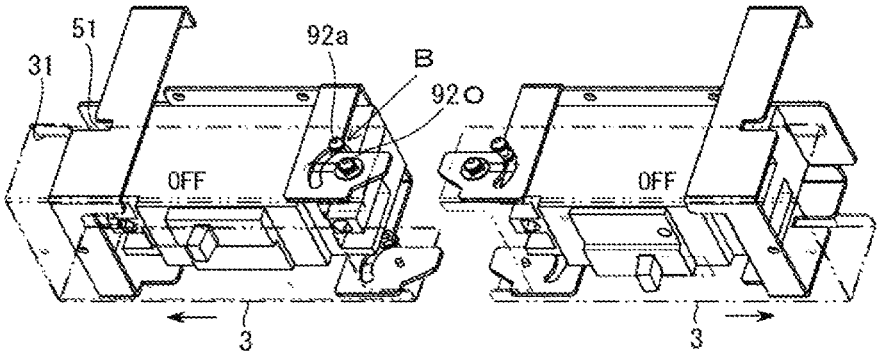
Figure 2C:
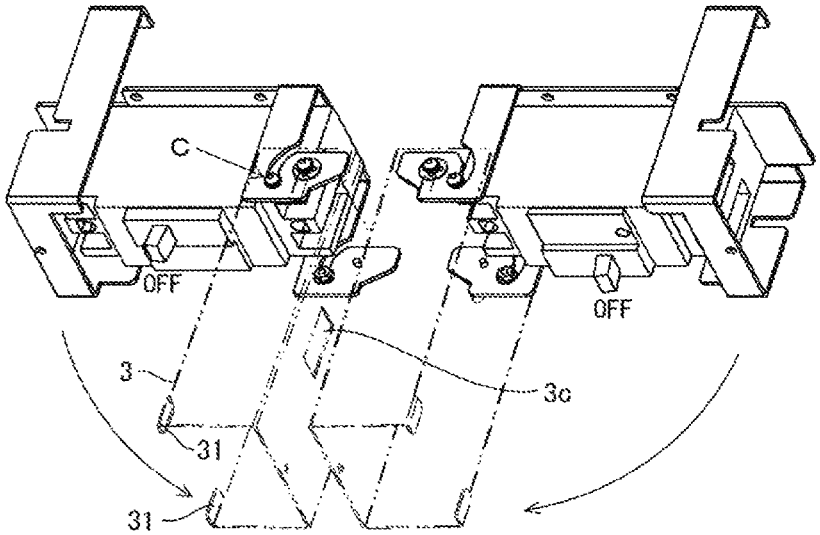

FIGS. 1A and 1B are views showing the entire configuration of a panel device according to Embodiment 1 of the present invention; FIG. 1A is a plan view and FIG. 1B is a perspective view. FIGS. 2A, 2B, and 2C are views for explaining an interlocking mechanism of a protective cover of the panel device according to Embodiment 1 of the present invention; FIG. 2A is a perspective view showing a state of a breaker being ON and a protective cover closing; FIG. 2B is a perspective view showing a state of the breaker being OFF and the protective cover sliding outward; and FIG. 2C is a perspective view showing a state of the breaker being OFF and the protective cover opening. In FIGS. 1A and 1B, a breaker panel 1 as the panel device is configured using a housing 11 with an opening/closing door 11*a* at its front part, breakers 2, which are a plurality of molded case circuit breakers housed inside the housing 11, and a protective cover 3 that individually covers an exposed live part of each of the breakers 2.

Additionally, the paired breakers 2 arranged right and left are disposed in this example point-symmetrically to each other in such a way that one of the breakers becomes ON when its ON/OFF knob 21 is moved inward (toward the other breaker of the breakers 2 arranged right and left) and becomes OFF when the ON/OFF knob 21 is moved outward of the breaker panel 1. Additionally, for the sake of convenience, when the paired breakers 2 are arranged right and left so that ON/OFF directions of the ON/OFF knob 21 become the right and left directions, a direction toward the other breaker viewed from any one of the breakers is referred to as the "inward" direction and the opposite direction of that is referred to as the "outward" direction in this document.

Figure 3A:
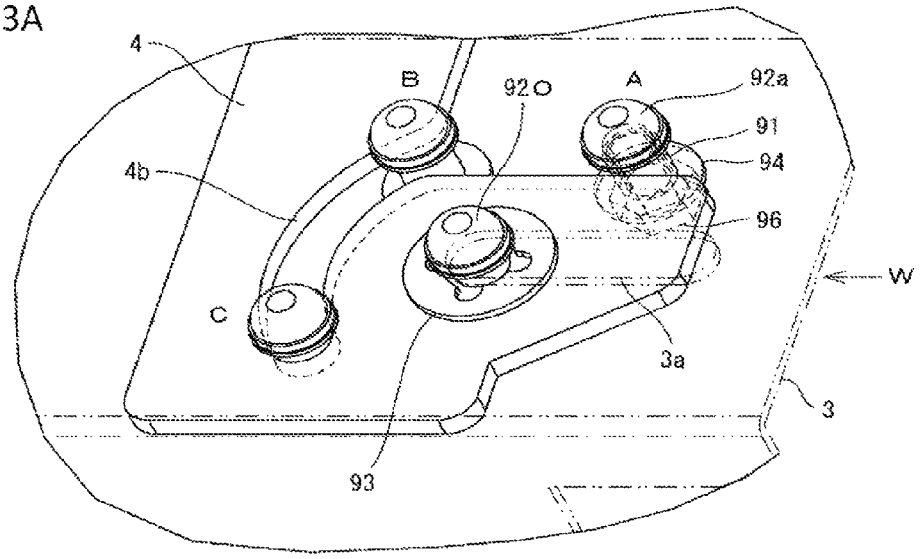
FIGS. 3A, 3B, 3C, and 3D are views for explaining in detail the essential part of the interlocking mechanism shown in FIGS. 2A, 2B, and 2C.
Figure 3B:
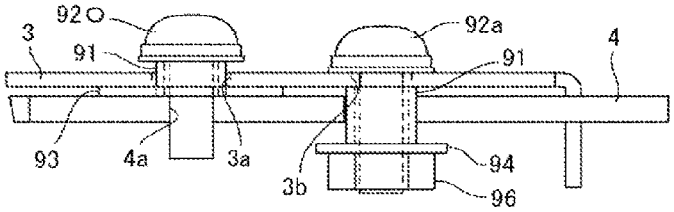
Figure 3D:
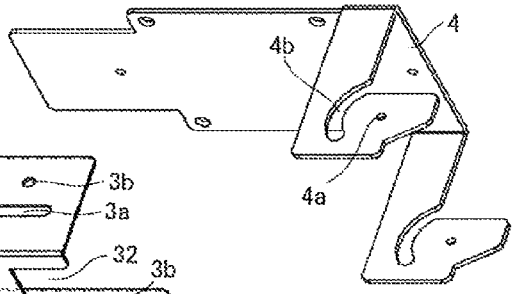
Figure 3C:
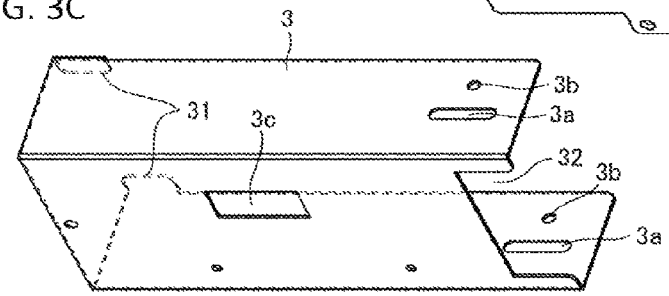

FIGS. 3A, 3B, 3C, and 3D are views for explaining in more detail the interlocking mechanism shown in FIGS. 2A, 2B, and 2C; the protective cover 3 is formed in a U-shape in cross section as shown in FIG. 3C; elongated holes 3*a* through which the turning central axis for opening and closing the protective cover passes are made vertically symmetrically in the upper side and lower side sections shown in FIG. 3C; in addition, round holes 3*b* (holes for circling screws, hereinafter referred to as the same) are similarly made vertically symmetrically, through which sems screw 92*a* that engages with a cover support member 4 described later is inserted; and in the front section of the cover is provided an insertion hole 3*c* through which the ON/OFF knob, an ON/OFF lever of the breakers 2, is inserted. Furthermore, engaging parts 31, which are tongue-shaped protrusions, are formed as shown in FIG. 3C symmetrically facing each other at upper and lower end portions in the opposite side of the elongated holes 3*a* (outer side of the panel) in the upper side and lower side sections of the protective cover 3; a monitoring window 32 for monitoring the live part is formed in the front section in the side of the elongated holes 3*a* (inner side). The engaging parts 31 can be provided in predetermined portions decided at suitable required locations distant from the turning center of the protective cover 3 so as to match with the location and shape of locking parts 51 of a cover locking member 5 described later.

Additionally, the insertion hole 3*c* is shaped in a rectangular elongated in the moving directions of the ON/OFF knob 21 (right and left directions here). Taking the left-hand side breaker of the breakers 2 in the figure, for example, the insertion hole is formed in such a way that when the ON/OFF knob 21 is brought into the ON state (turned on) after the protective cover 3 is slid to the inner end portion (in the right direction) and closed, the right end portion of the insertion hole nearly touches the right lateral face of the ON/OFF knob 21. Thereby, the protective cover 3 is restricted not to slide outward (in the left direction) when the ON/OFF knob 21 is in the ON state. Additionally, the insertion hole 3*c* is formed to have a length in the right and left directions in such a way that the left end portion thereof touches the left lateral face of the ON/OFF knob 21 even when the ON/OFF knob 21 is brought down in the OFF direction from the foregoing state, thereby prohibiting the protective cover 3 from moving outward.

The cover support member 4 made of a sheet metal is fixed to the housing 11 together with the breakers 2, and screw holes 4*a* for supporting the protective cover 3 and arc-shaped grooves 4*b* centering at these screw holes 4*a* are provided vertically symmetrically in upper and lower bent sections protruding frontward as shown in FIG. 3D. The cover locking member 5 that is made of a sheet metal and U-shaped in a size capable of fitting inside the protective cover 3 formed in the U-shape in cross section is fixed to suitable fixing portions of the breakers 2, the housing 11 or the like as shown in FIGS. 2A, 2B, and 2C, and provided with the locking parts 51, such as notches or grooves, which are formed at upper and lower two locations by cutting away portions thereof from the outer side toward the inner side, and engage with their respective engaging parts 31 of the protective cover 3 when the cover is closed, so as to restrict turning of the protective cover 3.

As shown in FIGS. 3A, 3B, 3C, and 3D, a cylindrical spacer 91 is inserted through each of the elongated holes 3*a* of the protective cover 3, furthermore a sems screw 92O, which is a screw assembled with a washer, is inserted through the center of the spacer 91, and fastened and fixed via a nylon washer 93 to the screw holes 4*a* made in the cover support member 4. Thereby, the protective cover 3 becomes able to slide along the elongated holes 3*a* and also turn around the sems screw 92O. On the other hand, sems screw 92*a* inserted through each of the round holes 3*b* of the protective cover 3 from the front side is fitted with the cylindrical spacer 91 and a washer 94 from the back side and then fastened and fixed by a nut 96 as shown in FIG. 3B.

Additionally, in order to distinguish two sems screws numbered with 92 from each other for the sake of convenience in explaining operation, the screw that serves as the turning central axis when the protective cover 3 is opened/closed is referred to as the "sems screw 92O" and the screw that circles around the sems screw 92O together with the protective cover 3 is referred to as the "sems screw 92*a*" in this Embodiment 1. Since configurations other than the above-described interlocking mechanism are the same as those of the conventional device, their explanation will be omitted.

Next, the operation of Embodiment 1 configured as described above will be explained. First, when the breakers 2 are in the ON state, the spacer 91 fixed at the round holes 3*b* part of the protective cover 3 lies at the position A shown in FIG. 2A and FIG. 3A, and the sems screw 92O part that is inserted through the elongated holes 3*a* of the protective cover 3 and slidably and turnably fixes the protective cover 3 lies at the position in the outer side of the elongated holes 3*a* (left side in FIG. 3A). The engaging parts 31, which are protrusions formed at the upper and lower portions in the back side of the protective cover 3, are fitted into the locking parts 51 of the cover locking member 5 and locked in this state as shown in FIG. 2A; therefore, the protective cover 3 cannot be opened.

The ON/OFF knob 21 is brought down inward when the breakers 2 are in the ON state, the inner side end portion (right end portion in FIG. 3C) of the insertion hole 3*c* that is made in the front section of the protective cover 3 and through which the ON/OFF knob 21 is inserted touches the ON/OFF knob 21 and is restrained, whereby the protective cover 3 cannot be slid outward, and as a result, the protective cover is brought into a state of being unable to open. Therefore, the not-shown live part of the breakers 2 is covered by the protective cover 3.

Next, when the breakers 2 are brought into the OFF state, the ON/OFF knob 21 is brought down outward as shown in FIG. 2B, whereby the protective cover 3 becomes ready to slide outward by the same distance as the ON/OFF knob 21 has moved from the inner side to the outer side. When the protective cover 3 is manually slid outward as shown by the arrow in FIG. 2B, the spacer 91 and the sems screw 92*a* that are fixed at the round holes 3*b* come to the position B; meanwhile, the sems screw 92O that is inserted through the elongated holes 3*a* and serves as the turning central axis of the protective cover 3 moves to the inner position of the elongated holes 3*a*. The engaging parts 31, which are protrusions formed at the upper and lower portions in the back side of the protective cover 3, are released from the locking parts 51 of the cover locking member 5, so that the protective cover 3 becomes able to be opened.

When the end portion in the outer side of the protective cover 3 is pulled frontward (front side), the protective cover 3 turns around the sems screw 92O that has moved to the position in the inner side of the elongated holes 3*a*, and the spacer 91 inserted through the round holes 3*b* of the protective cover 3 moves to the position C along the arc-shaped grooves 4*b* of the cover support member 4, thereby enabling the protective cover 3 to open. The spacer 91 and the sems screw 92*a* at the round holes 3*b* part of the protective cover 3 stop at the position C that is the end portion of the grooves 4*b*, whereby the opening angle of the protective cover 3 is restricted, and also the sems screw 92O part inserted through the elongated holes 3*a* of the protective cover 3 serves as a fulcrum; therefore, when the protective cover 3 is in the open state, the protective cover 3 becomes unable to move inward, so as to avoid interfering with its neighboring protective cover.

If the breakers 2 are mistakenly turned on when the protective cover 3 is in the open state and then the protective cover is intended to be closed in that state, the ON/OFF knob 21 hits the back of the protective cover 3 and the cover cannot be closed. Furthermore, if the protective cover 3 is intended to be closed with the cover slid inward, the engaging parts 31 provided at the upper and lower portions in the back side of the protective cover 3 hit the cover locking member 5; the protective cover 3 is structurally made unable to be closed even in either case. Moreover, by providing the protective cover 3 with the monitoring window 32, change in color and the like of terminals of the internal live part can be inspected in safe from the outside.

In Embodiment 1 as described above, the elongated holes 3*a* are made in the protective cover 3 so as to provide the cover slidably with respect to the cover support member 4, and also the insertion hole 3*c* of the protective cover 3 interferes with the ON/OFF knob 21 when the breakers 2 are in the ON position, thereby making the protective cover 3 unable to slide. Furthermore, the engaging parts 31, which are protrusions formed at the upper and lower portions in the back side of the protective cover 3, are fitted into the locking parts 51 of the cover locking member 5, thereby making the protective cover 3 unable to open.

By doing in this way, opening/closing conditions of the protective cover 3 can be set, without providing the breaker 2 with a handle for interlocking, using only ON/OFF movement of the ON/OFF knob 21; the protective cover 3 cannot be opened when the breakers are in the ON state, but can be opened only when the breakers in the OFF state. Since the interlocking mechanism for the protective cover 3 provided on each of the breakers 2 can be released breaker by breaker, there is no danger such as mistakenly touching live parts of other breakers during maintenance, so that maintenance can be carried out in safe. Moreover, every member necessary for the above can be easily formed by, for example, metal pressing and the configuration can be simplified, so that the number of parts can be decreased. Furthermore, the breakers can use regular standardized parts, so that an effect of providing breakers at low cost can be also produced.

Embodiment 2

Figure 4A:
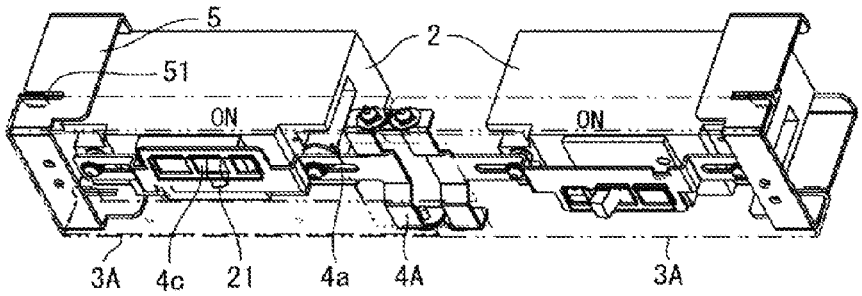
FIGS. 4A, 4B, and 4C are views for explaining an interlocking mechanism of a protective cover of a panel device according to Embodiment 2 of the present invention.
Figure 4B:
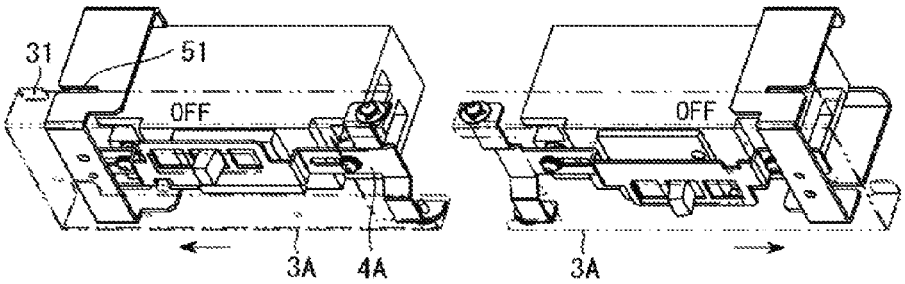
Figure 4C:
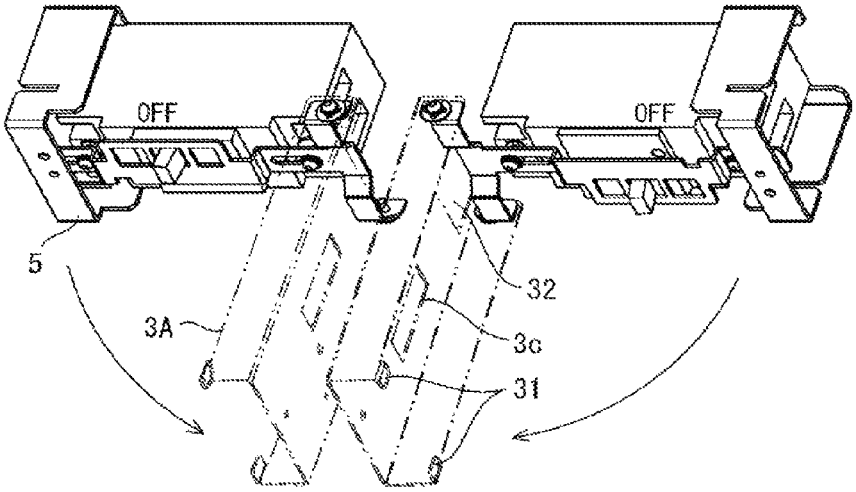
Figure 5A:
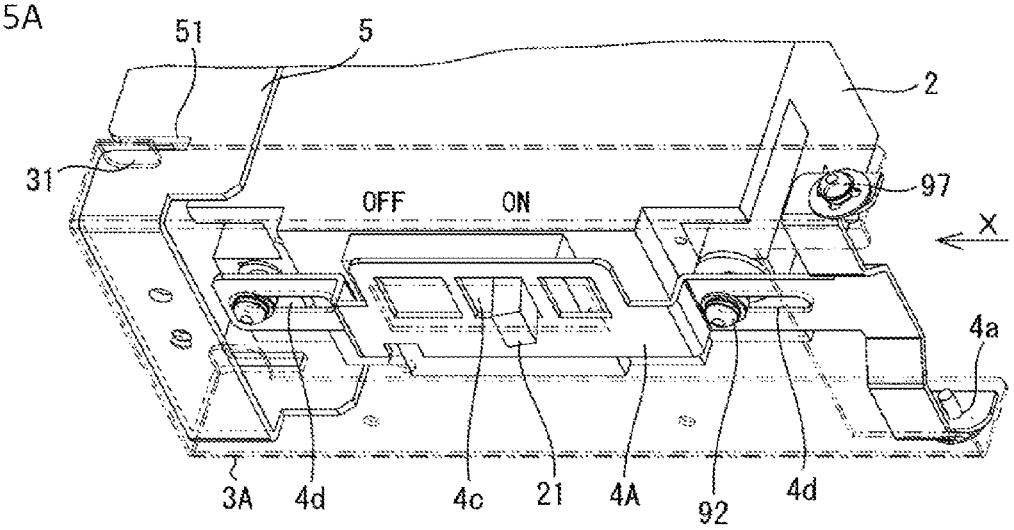
FIGS. 5A, 5B, 5C, and 5D are views for explaining in detail the essential part of the interlocking mechanism shown in FIGS. 4A, 4B, and 4C.
Figure 5B:
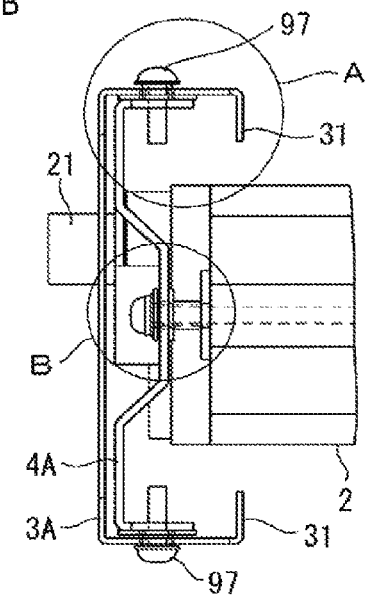
Figure 5C:
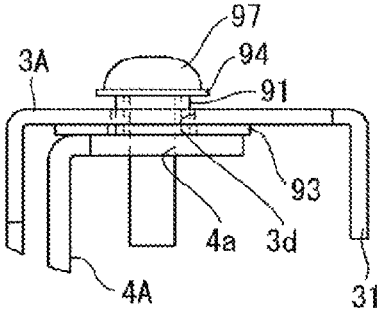
Figure 5D:
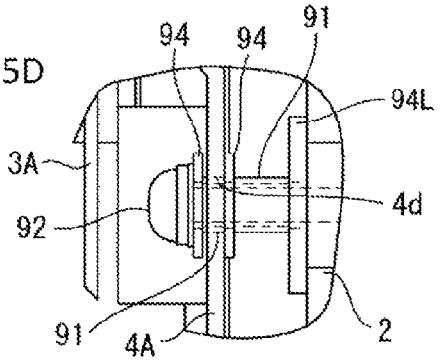

FIGS. 4A, 4B, and 4C are views for explaining an interlocking mechanism of a protective cover of a panel device according to Embodiment 2 of the present invention; FIG. 4A is a perspective view showing a state of the breaker being ON and the protective cover closing; FIG. 4B is a perspective view showing a state of the breaker being OFF and the protective cover sliding outward; and FIG. 4C is a perspective view showing a state of the breaker being OFF and the protective cover opening. FIGS. 5A, 5B, 5C, and 5D are views for explaining in more detail the interlocking mechanism shown in FIGS. 4A, 4B, and 4C; FIG. 5A is a detailed perspective view of the interlocking mechanism; FIG. 5B is an arrow view taken in the X direction of FIG. 5A; FIG. 5C is a detailed view of the portion A encircled in FIG. 5B; and FIG. 5D is a detailed view of the portion B encircled in FIG. 5B. Additionally, the protective cover 3 in Embodiment 1 is made to be manually slid outward after the breakers 2 are brought into the OFF state; however, in this Embodiment 2, when the breakers 2 are brought into the OFF state, the protective cover 3A also slides at the same time so as to be able to open.

As shown in FIGS. 4A, 4B, and 4C, a cover support member 4A is provided with a rectangular hole 4*c* that is formed to engage with the ON/OFF knob 21 so that the cover support member 4A itself can slide in the right and left directions of the figure in conjunction with the ON/OFF knob 21, the screw holes 4*a* (shown in FIG. 5A, FIG. 5C) at which the protective cover 3A is screwed by a screw 97 that turnably supports the cover at upper and lower two locations as shown in FIG. 5B, and elongated holes 4*d* made at two locations through which the sems screw 92 that slidably supports the cover support member 4A with respect to the breakers 2 is inserted. The insertion hole 3*c* (shown in FIG. 4C), which is the same as that of Embodiment 1, is made in the front section of the protective cover 3A; at the upper and lower sections thereof are provided round holes 3*d* each of which the screw 97 that turnably supports the protective cover 3A is inserted. The cylindrical spacer 91 is inserted through each of the round holes 3*d* at the upper and lower sections of the protective cover 3A as shown in FIG. 5C, furthermore the screw 97 is inserted through the spacer 91, and the protective cover is fixed to the upper and lower screw holes 4*a* of the cover support member 4A by the screw 97 via the nylon washer 93, thereby enabling the protective cover 3A to turn with the spacer 91 (screw 97) serving as the axis.

The ON/OFF knob 21 of the breakers 2 is inserted through the rectangular hole 4*c* of the cover support member 4A, and the elongated holes 4*d* made at the two locations are fixed as shown in FIG. 5D. First, a large washer 94L that is larger than the washer 94 in diameter, the cylindrical spacer 91 and the washer 94 are stacked up in this order at each of fixing holes 22 of the breakers 2, on which another spacer 91 is placed, and this spacer 91 is made to pass through the elongated holes 4*d* of the cover support member 4A. Then, another washer 94 is placed on this spacer 91 and these are fastened together with the breakers 2 by the sems screw 92. By doing in this way, the cover support member 4A becomes able to slide right and left in conjunction with ON/OFF movement of the breakers 2. Since the protective cover 3A is fixed to the cover support member 4A, the cover slides right and left in FIGS. 4A, 4B, and 4C together with the cover support member 4A. Other configurations, such as the cover locking member 5, are the same as those of Embodiment 1, so their explanation will be omitted.

In Embodiment 2 as configured above, the ON/OFF knob is brought down inward when the breakers 2 are in the ON state, and at the same time, the cover support member 4A and the protective cover 3A also slide inward. In this state, the engaging parts 31, which are tongue-shaped protrusions provided at the upper and lower portions in the back side of the protective cover 3A, are fitted into the locking parts 51 of the cover locking member 5, thereby making the protective cover 3A unable to open. When the breakers 2 are brought into the OFF state, the ON/OFF knob is brought down outward, and the cover support member 4A and the protective cover 3A also slide outward at the same time. When these slide outward, the engaging parts 31 provided at the upper and lower portions in the back side of the protective cover 3A are released from the locking parts 51 of the cover locking member 5, thereby enabling the protective cover 3A to open by pulling it frontward.

If the breakers 2 are mistakenly turned on when the protective cover 3A is in the open state and then the protective cover 3A is intended to be closed in this state, the ON/OFF knob 21 is brought down inward, and at the same time, both of the cover support member 4A and the protective cover 3A come into a state of sliding inward. Even if the protective cover 3A is intended to be closed in this state, the engaging parts 31 provided at the upper and lower portions in the back side of the protective cover 3A hit an upper end portion of the cover locking member 5, thereby making the protective cover 3A unable to close. Additionally, the same as Embodiment 1, change in color and the like of internal terminals can be inspected in safe, without opening the protective cover 3A, from the outside through the monitoring window 32 provided in this protective cover 3A.

According to Embodiment 2 as described above, opening/closing conditions of the protective cover 3 can be set, without providing a handle for interlocking on the breakers 2, by only the ON/OFF movement of the ON/OFF knob 21; the protective cover 3A cannot be opened when the breakers 2 are in the ON state, but can be opened only when the breakers 2 in the OFF state. Since the interlocking mechanism for the protective cover 3A provided on each of the breakers 2 can be released breaker by breaker, there is no danger such as mistakenly touching live parts of other breakers during maintenance, so that maintenance can be carried out in safe. Moreover, the configuration of the device becomes simple, the number of parts can be decreased, and the breakers 2 can use regular standardized parts, which will also produce an effect capable of providing breakers at low cost.

Embodiment 3

Figure 6A:
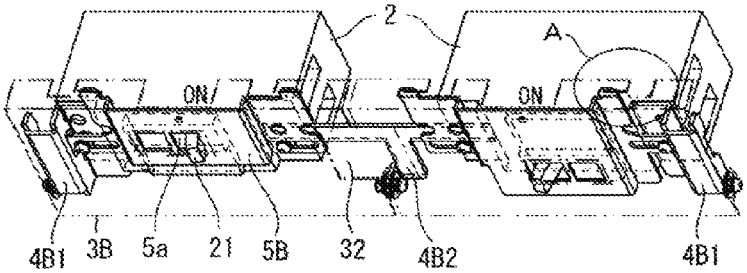
FIGS. 6A, 6B, and 6C are views for explaining an interlocking mechanism of a protective cover of a panel device according to Embodiment 3 of the present invention.
Figure 6B:
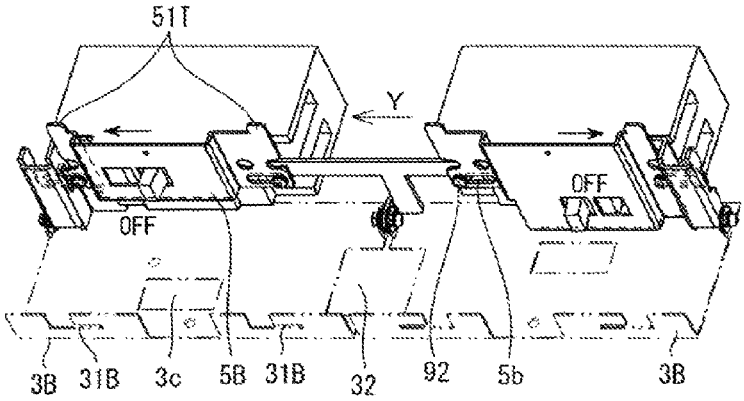
Figure 6C:
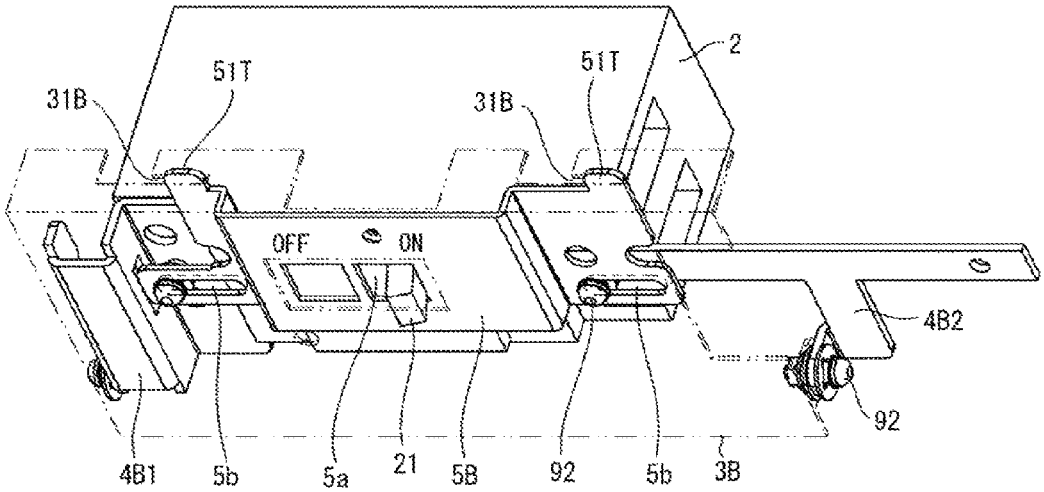
Figure 7A:
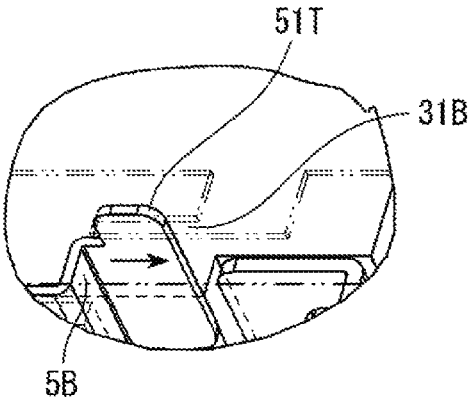
Figure 7B:
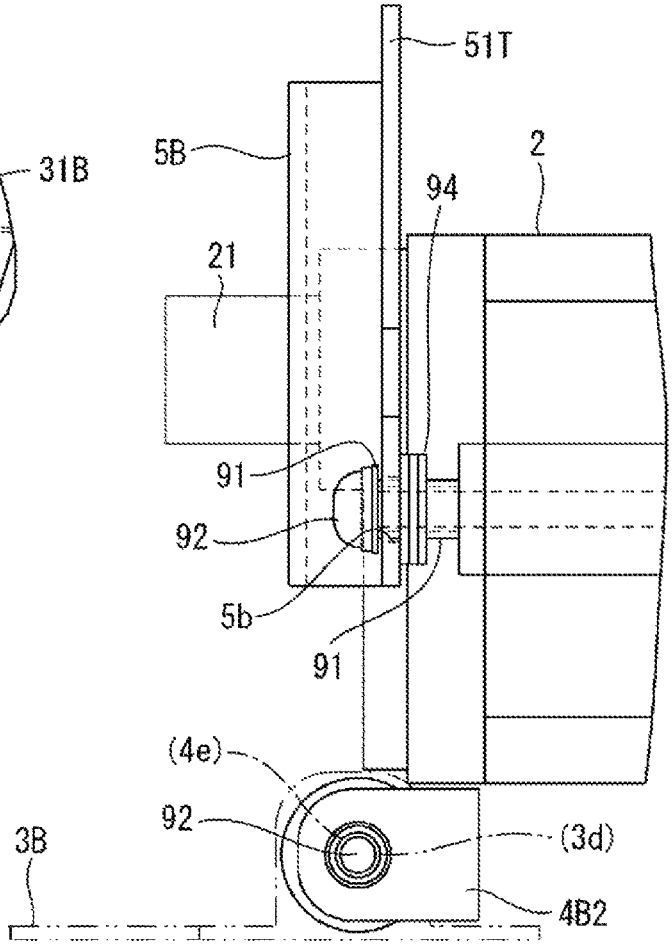

FIGS. 6A, 6B, and 6C are views for explaining an interlocking mechanism of a protective cover of a panel device according to Embodiment 3 of the present invention; FIG. 6A is a perspective view showing a state of the breaker being ON and the protective cover closing; FIG. 6B is a perspective view showing a state of the breaker being OFF and the protective cover opening; and FIG. 6C is a perspective view showing in detail the interlocking mechanism. FIGS. 7A, 7B, and 7C are views for explaining in detail the essential part of the interlocking mechanism shown in FIGS. 6A, 6B, and 6C; FIG. 7A is a detailed view of the portion A encircled in FIG. 6A; and FIG. 7B is an arrow view taken in the Y direction of FIG. 6B. Additionally, the main difference between Embodiment 3 and Embodiments 1 and 2 described above is that a protective cover 3B does not slide but is made to open from the upper side toward the lower side, and a cover locking member 5B is configured to be able to slide in conjunction with the ON/OFF knob 21, thereby controlling opening/closing of the protective cover 3B.

In FIGS. 6A, 6B, and 6C, the cover locking member 5B is provided with in the front section thereof a rectangular hole 5*a* that is formed to engage with the ON/OFF knob 21 so as to be able to move right and left in conjunction with movement of the knob, and at two locations thereof elongated holes 5*b* that support the cover locking member 5B slidably with respect to the breakers 2, and furthermore locking parts 51T, which are tongue-shaped protrusions projecting upward, are provided at two locations. The protective cover 3B is provided with in the right and left lower sections thereof round holes 3*d* (not shown) for turning, in the front section thereof the insertion hole 3*c* through which the ON/OFF knob 21 shown in FIG. 6C is inserted (see FIG. 6B), and at right and left two locations in the upper section thereof engaging parts 31B, which are L-shaped notches for receiving and engaging with the locking parts 51T, as well as the monitoring window 32. As shown in FIG. 6C, a support member that turnably supports the protective cover 3B includes a cover support member 4B1 that is attached to both outer side portions of the paired breakers 2 arranged side by side and a cover support member 4B2 that is attached to the central portion thereof; both are rigidly fixed to the breakers 2 and cannot be moved. Additionally, the nearly T-shaped cover support member 4B2 is shared between the breakers 2 in the right and left sides.

In assembling, the spacer 91 and the washer 94 are placed at first on a fixing part of the breakers 2 as shown in FIG. 7B, furthermore another spacer 91 is placed on that, and this spacer 91 is inserted through one of the elongated holes 5*b* of the cover locking member 5B. Then, another washer 94 is placed on this spacer 91, and these are fixed together with the breakers 2 by the sems screw 92. The ON/OFF knob 21 of the breakers 2 is inserted through the rectangular hole 5*a* in the front section of the cover locking member 5B. Thereby, the cover locking member 5B becomes able to slide right and left in conjunction with the movement of the ON/OFF knob 21.

An internally-threaded screw hole 4*a* (not shown) is made in the cover support member 4B1 attached to both sides of the breakers, and the cover support member 4B2 attached to the central part is provided with a round hole 4*e*. (Additionally, none of round hole, spacer, washer, nut, etc are not given reference numerals in the drawings in this paragraph.) In both sides of the protective cover 3B, the spacer 91 is inserted through the round holes 3*d* made in the protective cover 3B, and the sems screw 92 is inserted through the spacer 91 and screwed to the screw hole 4*a* of the cover support member 4B1. In the central side of the protective cover 3B, the spacer 91 is inserted through the round holes 3*d* in the central side of the right-hand side and the left-hand side protective cover 3B and the round hole 4*e* of the cover support member 4B2 at the same time so as to fix these using the sems screw 92, the washer 94 and the nut 96. By doing in this way, the right-hand side and the left-hand side protective cover 3B become able to open from the upper side toward the lower side.

In Embodiment 3 as configured above, the ON/OFF knob is brought down inward when the breakers 2 are in the ON state, and accordingly the cover locking member 5B also slides inward at the same time. In this state, the locking parts 51T provided at the two locations in the upper side of the cover locking member 5B are fitted into the engaging parts 31B provided at the two locations in the upper side of the protective cover 3B, thereby making the protective cover 3B unable to open (see FIG. 6C).

When the breakers 2 are brought into the OFF state, the ON/OFF knob 21 of the breakers 2 is brought down outward, and accordingly the cover locking member 5B slides outward at the same time. When the cover locking member 5B slides outward, the locking parts 51T provided at the two locations in the upper side of the cover locking member 5B are released from the engaging parts 31B provided at the two locations in the upper side of the protective cover 3B, thereby making the protective covers 3B able to open.

If the breakers 2 are mistakenly turned on when the protective cover 3B is in the open state and then the protective cover 3B is intended to be closed in this state, the ON/OFF knob 21 is brought down inward by the turn-on operation, and accordingly the cover locking member 5B is also brought into a state of sliding inward. Therefore, if the protective cover 3B is intended to be closed in this state, the locking parts 51T provided at the two locations in the upper side of the cover locking member 5B are brought into a state of not engaging with the engaging parts 31B provided at the two locations in the upper side of the protective cover 3B, thereby making the protective cover 3B unable to close. In addition, change in color and the like of internal terminals can be inspected in safe, without opening the protective cover 3B, from the outside through the monitoring window 32.

According to Embodiment 3 as described above, opening/closing conditions of the protective cover 3 can be set, without providing a handle for interlocking on the breakers 2, by only the ON/OFF movement of the ON/OFF knob 21; the protective cover 3B cannot be opened when the breakers 2 are in the ON state, but can be opened only when the breakers 2 are in the OFF state. Since the interlocking mechanism for the protective cover 3B provided on each of the breakers 2 can be released breaker by breaker, there is no danger such as mistakenly touching live parts of other breakers during maintenance, so that maintenance can be carried out in safe. Moreover, the configuration of the device becomes simple, the number of parts can be decreased, and the breakers 2 can use regular standardized parts, thereby also producing an effect of providing breakers at low cost.

Embodiment 4

Figure 8A:
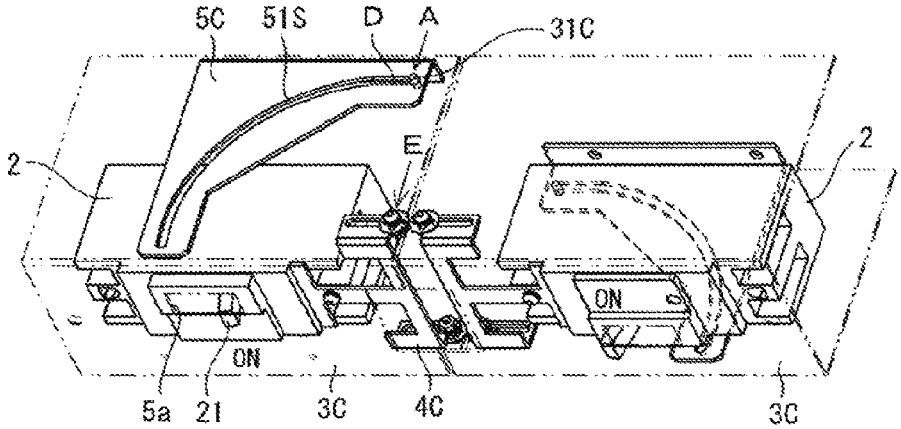
FIGS. 8A, 8B, and 8C are views for explaining an interlocking mechanism of a protective cover of a panel device according to Embodiment 4 of the present invention.
Figure 8B:
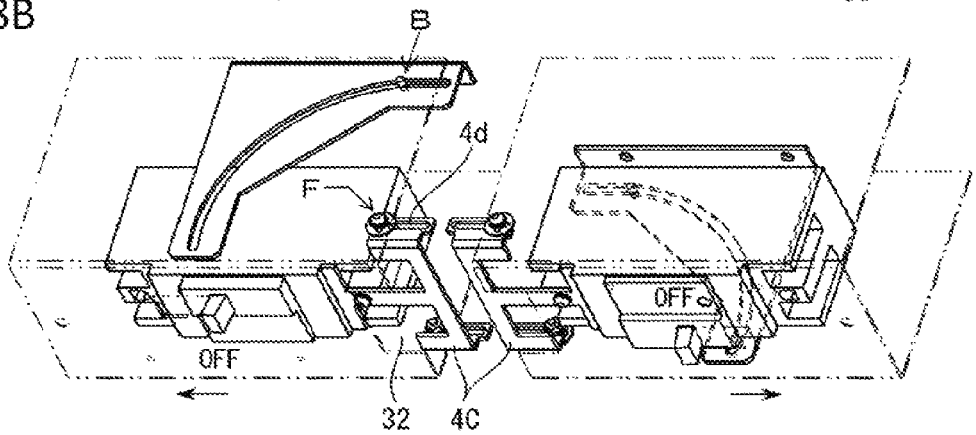
Figure 8C:
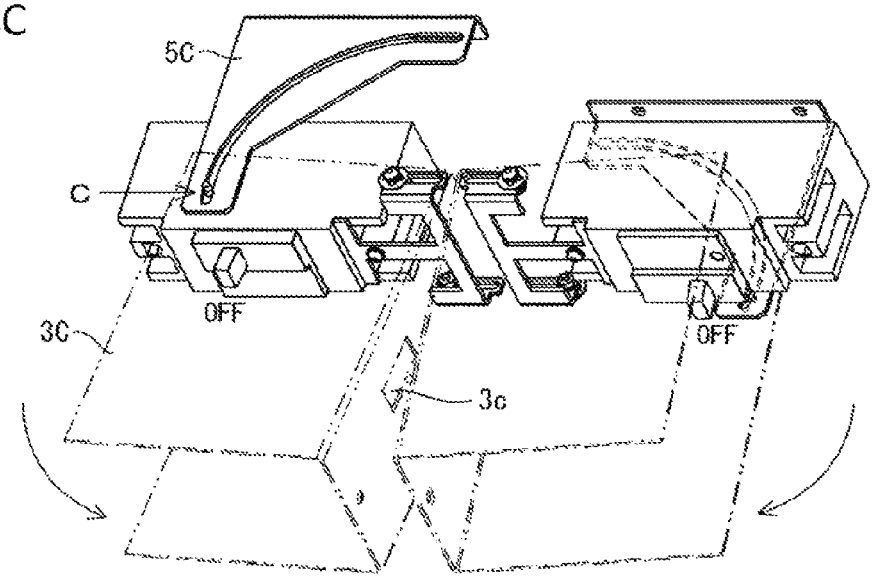
Figure 9A:
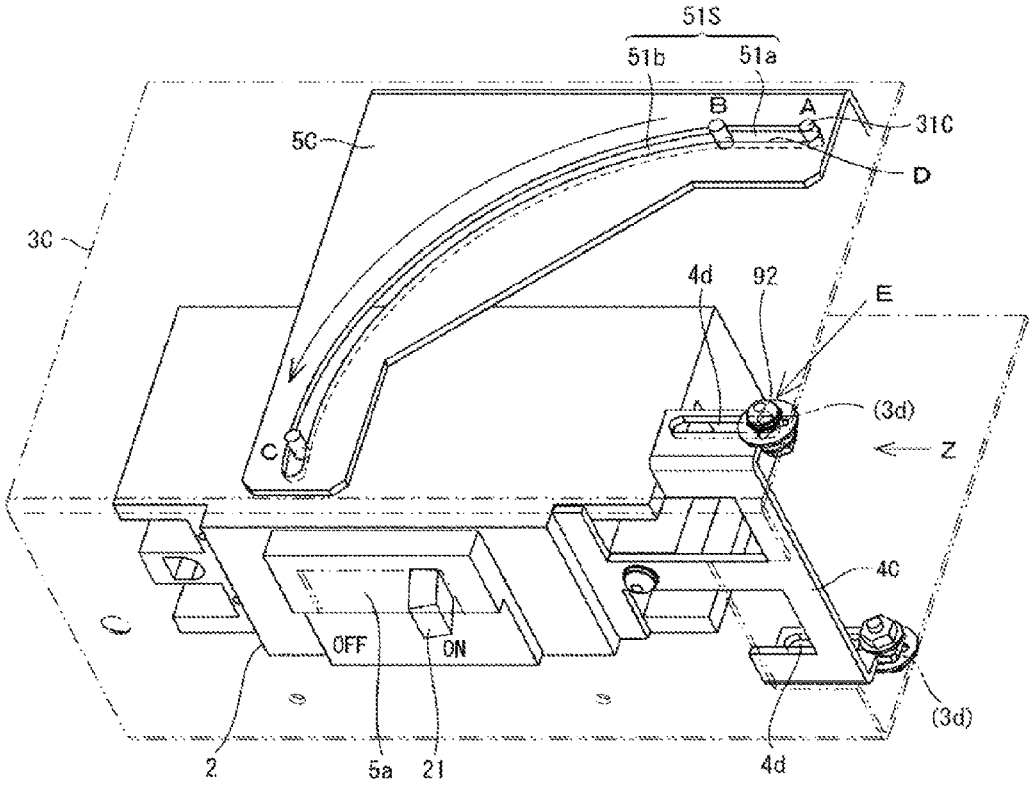
FIGS. 9A and 9B are views for explaining in detail the essential part of the interlocking mechanism shown in FIGS. 8A, 8B, and 8C.
Figure 9B:
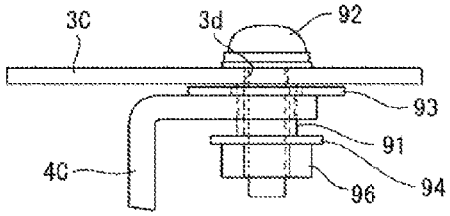

FIGS. 8A, 8B, and 8C are views for explaining an interlocking mechanism of a protective cover of a panel device according to Embodiment 4 of the present invention; FIG. 8A is a perspective view showing a state of the breaker being ON and the protective cover closing; FIG. 8B is a perspective view showing a state of the breaker being OFF and the protective cover sliding outward; and FIG. 8C is a perspective view showing a state of the breaker being OFF and the protective cover opening. FIGS. 9A and 9B are views for explaining in more detail the interlocking mechanism shown in FIGS. 8A, 8B, and 8C; FIG. 9A is a detailed perspective view of the interlocking mechanism; and FIG. 9B is an arrow view of the essential part thereof taken in the Z direction in FIG. 9A. Additionally, in this Embodiment 4, a protective cover 3C and its turning central axis are made movable in conjunction with movement of the ON/OFF knob 21, and an engaging part 31C is configured using an engaging pin disposed in parallel to the turning central axis at a radially predetermined distance from the axis. On the other hand, a cover locking member 5C is configured using a sheet guide member having a locking part 51S made of a slit guide groove formed including a straight section that is parallel to the directions to guide to slide the engaging pin and has the same length as the sliding distance of the engaging pin and an arc section that continuously connects to the straight section.

As shown in FIG. 9A, the protective cover 3C with a U-shaped cross section is provided with round holes 3*d* each located in the upper side and lower side sections thereof and an engaging part 31C that is the engaging pin and erected at the radially predetermined distance from the round holes 3*d*; in the front section thereof is provided the insertion hole 3*c*, the same as that of Embodiment 1 (shown in FIG. 8C), through which the ON/OFF knob 21 is inserted. A cover support member 4C is provided with the elongated holes 4*d* that are elongated in the right and left directions and each located in the upper and lower sections thereof. As shown in FIG. 9B, the round holes 3*d* of the protective cover 3C are laid on their respective elongated holes 4*d* (not shown) via the nylon washer 93, the cylindrical spacer 91 is inserted from the back side, and these are fixed together by the sems screw 92, the washer 94 and the nut 96. The cover support member 4C is fixed to the breakers 2 and does not move. The cover locking member 5C is made of a sheet material having the locking part 51S provided with the guide groove that engages with the engaging part 31C and is formed including the straight section 51*a* that is parallel to the elongated directions of the holes 4*d*, that is, the sliding directions of the protective cover 3C, and has the same length as the sliding distance of the cover, and the arc section 51*b* that continuously connects to the straight section 51*a*. The cover locking member 5C is fixed to the housing 11 (shown in FIGS. 1A and 1B) by a not-shown fixing member.

Then, the engaging part 31C erected on the protective cover 3C is fitted into the locking part 51S of the cover locking member 5C as shown in FIG. 9A. Additionally, let one end portion of the straight section 51*a* of the locking part 51S be a position A, the connecting point of the straight section 51*a* with the arc section 51*b*, a position B, the other end portion of the arc section 51*b*, a position C, the inner end portion of the elongated holes 4*d*, a position E, and the outer end portion thereof, a position F. In a state of the protective cover 3C sliding inward and closing, the turning central axis of the protective cover 3C lies at the position E and the engaging part 31C, which is the engaging pin, lies at the position A. The turning central axis of the protective cover 3C moves to the position F and the engaging part 31C to the position B when the protective cover 3C is slid outward. The curvature center of the arc section 51*b* is formed to coincide with the turning center when the turning central axis is at the position F. By doing in this way, the protective cover 3C becomes able to move along the elongated holes 4*d* of the cover support member 4C and the locking part 51S of the cover locking member 5C. The ON/OFF knob 21 of the breakers 2 is inserted through the insertion hole 3*c* in the front face of the protective cover 3C. The protective cover 3C is provided with the monitoring window 32.

In Embodiment 4 as configured above, when the breakers 2 are in the ON state, the ON/OFF knob 21 is brought down inward, and the protective cover 3C is also in a state of having moved inward, the turning central axis of the protective cover 3C lies at the position E in the inner side of the elongated holes 4*d*, and as a result, the engaging part 31C of the protective cover 3C comes to the position A. At this moment, the inner side end portion of the insertion hole 3*c* of the protective cover 3C touches the ON/OFF knob 21, so that the protective cover 3C is in a state of being unable to slide outward. If the protective cover 3 is intended to be opened frontward in this state, the engaging part 31C of the protective cover 3C interferes with a face D of the locking part 51S of the cover locking member 5C, in the turning central axis side of the straight section 51*a*, thereby making the protective cover 3C unable to open. In this example, the straight section 51*a* of the locking part 51S serves as a practical locking part.

When the breakers 2 are brought into the OFF state, the ON/OFF knob 21 is brought down outward, thereby making the protective cover 3C ready to slide outward. Then, when the protective cover 3C is manually slid outward, the position of the turning central axis of the protective cover 3C comes to the position F in the outer side of the elongated holes 4*d* of the cover support member 4C, and the engaging part 31C of the protective cover 3C comes to the position B. If the protective cover 3C is opened frontward in this state, the sems screw 92, which is the turning central axis of the protective cover 3C, serves as a fulcrum, the engaging part 31C moves from the position B to the position C along the arc section 51*b* of the locking part 51S, thereby making the protective cover 3C able to open. Then, the engaging part 31C of the protective cover 3C stops at the position C, whereby the opening angle of the protective cover 3C can be restricted. Even if the protective cover 3C is pulled inward when in the open state, the engaging part 31C at the position C is restrained by the locking part 51S of the cover locking member 5C, and the protective cover 3C cannot move inward; therefore, the protective cover 3C can be prevented from interfering with that of the neighboring breaker of the breakers 2 arranged side by side.

If the breakers 2 are mistakenly turned on when the protective cover 3C is in the open state and then the protective cover 3C is intended to be closed in this state, the ON/OFF knob 21 hits the back of the protective cover 3C, and as a result, the cover is brought into a state of being unable to completely close. The engaging part 31C of the protective cover 3C stops on the arc section of the locking part 51S of the cover locking member 5C; therefore, the engaging part 31C cannot move to the position B, and the protective cover 3C cannot slide inward, thereby making the protective cover 3C unable to close.

According to Embodiment 4 as described above, the same effects as those of Embodiments 1 to 3 can be produced, such as the protective cover 3C cannot be opened when the breakers 2 are in the ON state, but can be opened only when the breakers 2 are in the OFF state.

Additionally, the engaging part 31C of the protective cover 3C is made of an engaging pin, and the locking part 51S of the cover locking member 5C is made of a slit guide groove formed of the straight section and the arc section continuously connecting to the straight section; however, it is also possible to provide a guide groove in the protective cover 3C side and configure the locking part 51S of the cover locking member 5C using a locking pin.

Embodiment 5

Figure 10A:
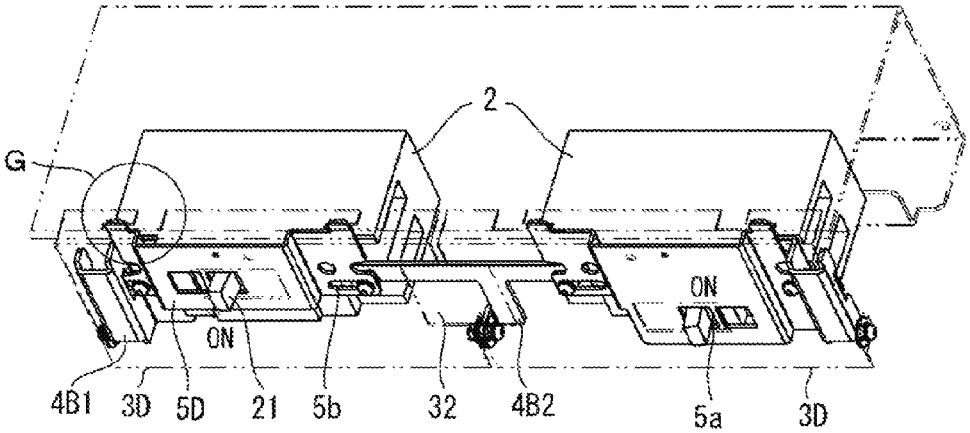
FIGS. 10A and 10B are views for explaining an interlocking mechanism of a protective cover of a panel device according to Embodiment 5 of the present invention.
Figure 10B:
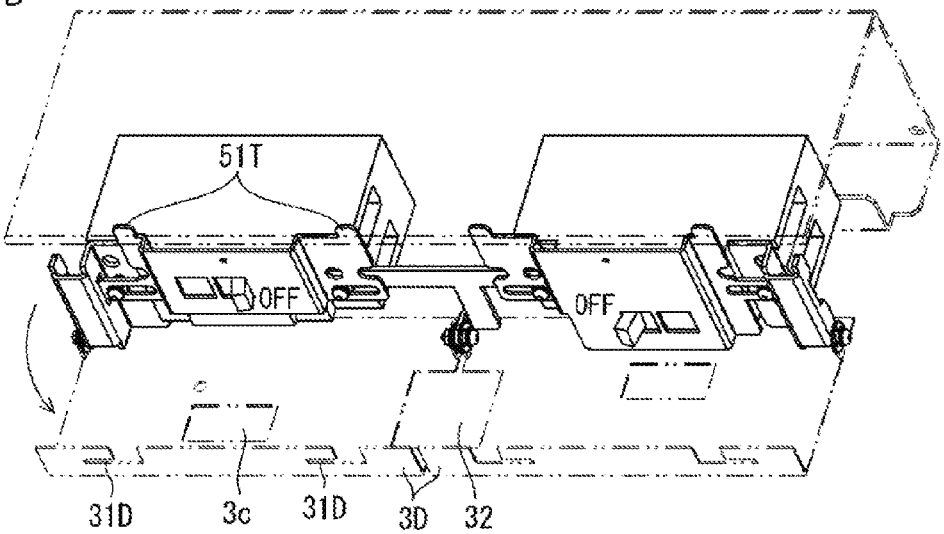
Figure 11A:
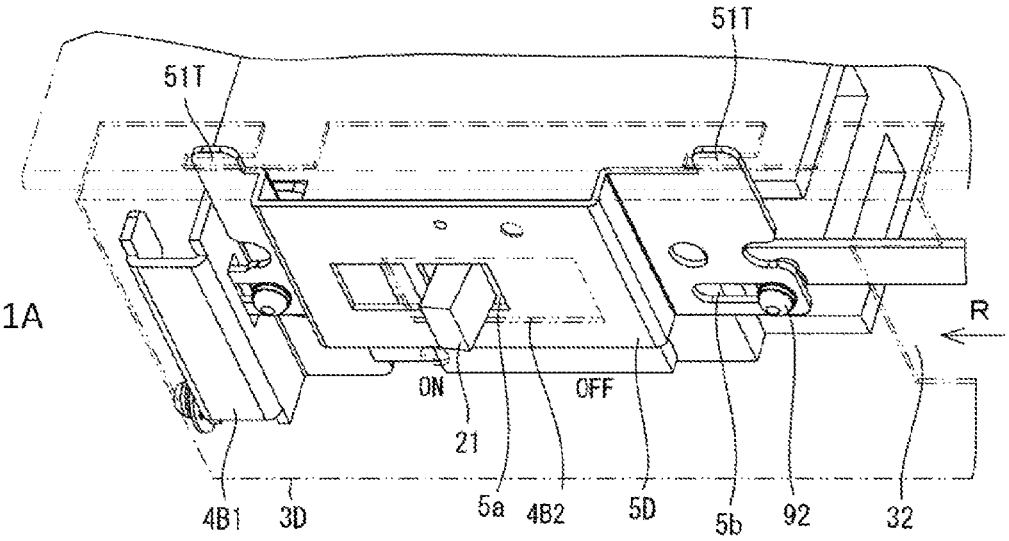
FIGS. 11A and 11B are views for explaining in detail the essential part of the interlocking mechanism shown in FIGS. 10A and 10B.
Figure 11B:
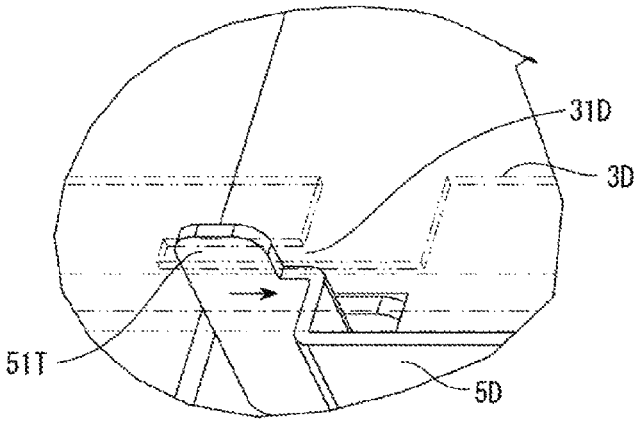
Figure 12A:
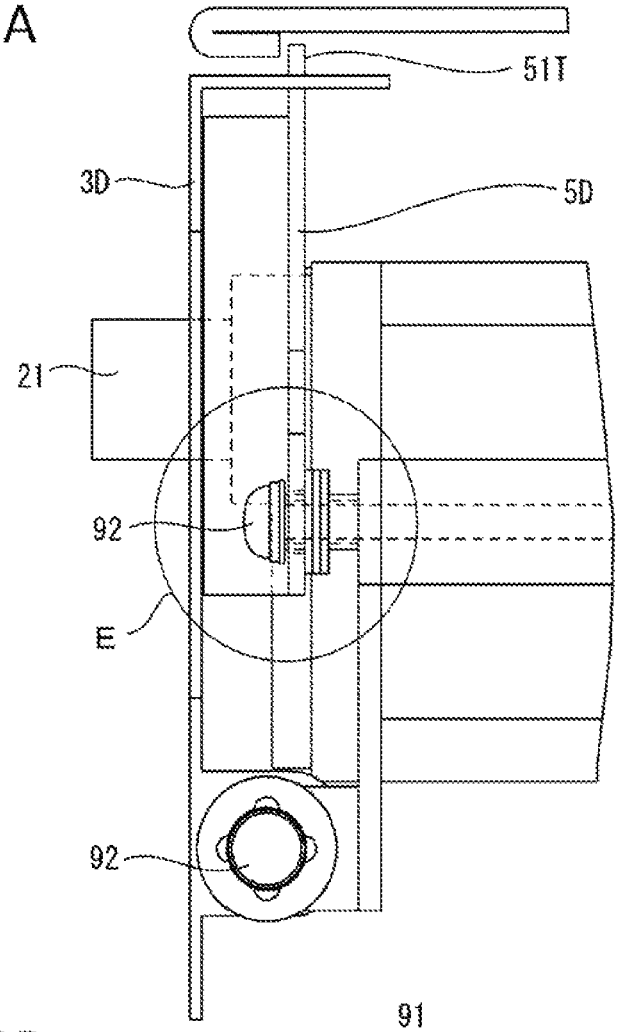
FIGS. 12A and 12B are another views for explaining in detail the essential part of the interlocking mechanism shown in FIGS. 10A and 10B.
Figure 12B:
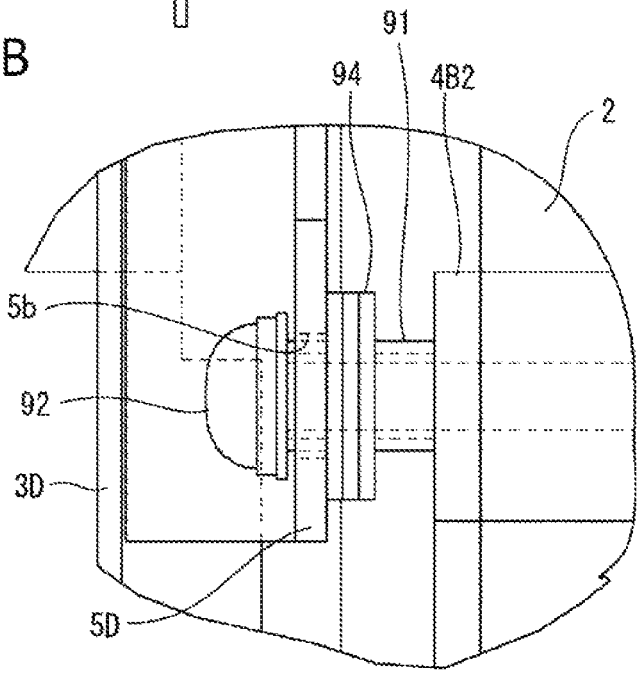

FIGS. 10A and 10B are views for explaining an interlocking mechanism of a protective cover of a panel device according to Embodiment 5 of the present invention; FIG. 10A is a perspective view showing a state of the breaker being ON and the protective cover closing; and FIG. 10B is a perspective view showing a state of the breaker being OFF and the protective cover opening. FIGS. 11A and 11B are views for explaining in more detail the interlocking mechanism shown in FIGS. 10A and 10B; FIG. 11A is a detailed perspective view of the interlocking mechanism; and FIG. 11B is a detailed view of the portion G encircled in FIG. 10A. FIG. 12A is an arrow view taken from the direction R of FIG. 11A; FIG. 12B is a detailed view of the portion E encircled in FIG. 12A. Additionally, this Embodiment 5 is an example in which the arrangement of the breakers 2 in Embodiment 3 described above is turned by 180°. Although the breakers 2 in Embodiment 3 are arranged in such a way that they are in the ON state when the ON/OFF knob 21 is in the inner side and in the OFF state when the knob in the outer side, the breakers in this Embodiment 5 are in the ON state when the ON/OFF knob 21 is in the outer side and in the OFF state when the knob is in the inner side.

The interlocking mechanism is basically the same as that of Embodiment 3; a cover locking member 5D is provided with in its front section the rectangular hole 5*a* that engages with the ON/OFF knob 21, at two locations thereof the elongated holes 5*b* that slidably support the cover locking member 5D with respect to the breakers 2, and furthermore at two locations thereof the locking parts 51T made of the tongue-shaped protrusions projecting upward. With ON/OFF directions of the ON/OFF knob 21 reversed with respect to those in Embodiment 3, the direction of grooves of the engaging parts 31D, which are L-shaped notches and provided at two locations to receive and engage with the locking parts 51T, is reversed as shown in FIG. 11B with respect to that in Embodiment 3 shown in FIG. 6C. Other configurations, such as the opening direction of the protective cover 3D and the monitoring window 32, are the same as those of Embodiment 3, so their explanation will be omitted.

In Embodiment 5 as configured above, the locking parts 51T provided at the two locations of the cover locking member 5D that moves, when the breakers 2 are in the ON state, in conjunction with the ON/OFF knob 21 of the breakers 2 are fitted into the engaging parts 31D provided at the two locations of the protective cover 3D, thereby making the protective cover 3D unable to open, so that the same effects as those in Embodiments 1 to 3 can be produced.

Embodiment 6

Figure 13A:
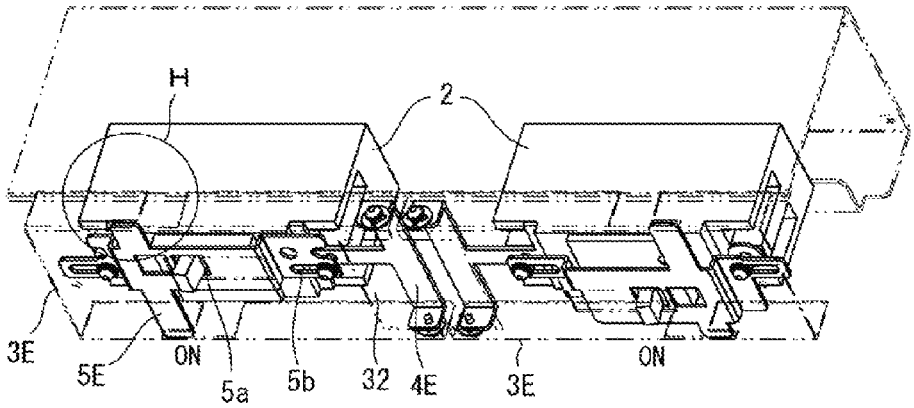
FIGS. 13A and 13B are views for explaining an interlocking mechanism of a protective cover of a panel device according to Embodiment 6 of the present invention.
Figure 13B:
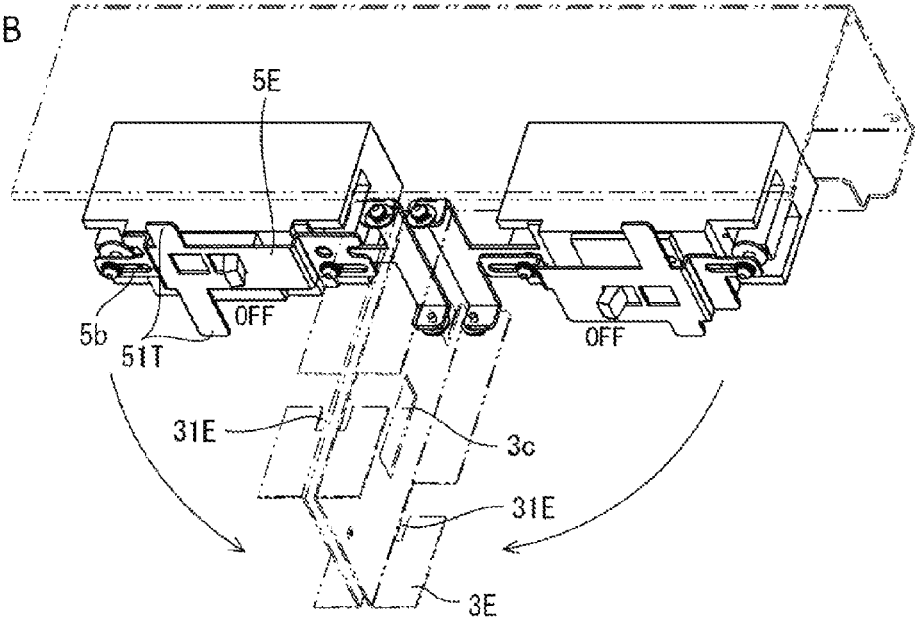
Figure 14A:
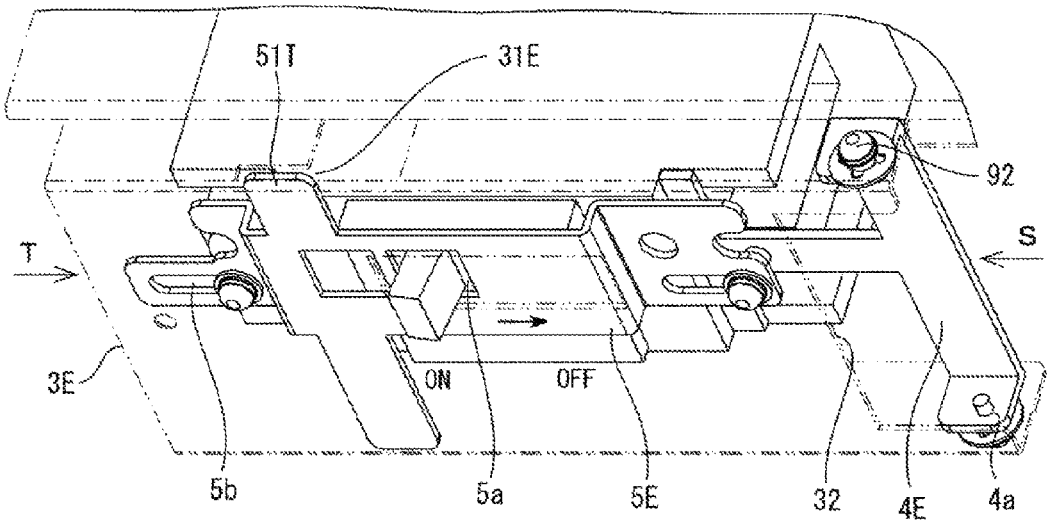
FIGS. 14A and 14B are views for explaining in detail the essential part of the interlocking mechanism shown in FIGS. 13A and 13B.
Figure 14B:
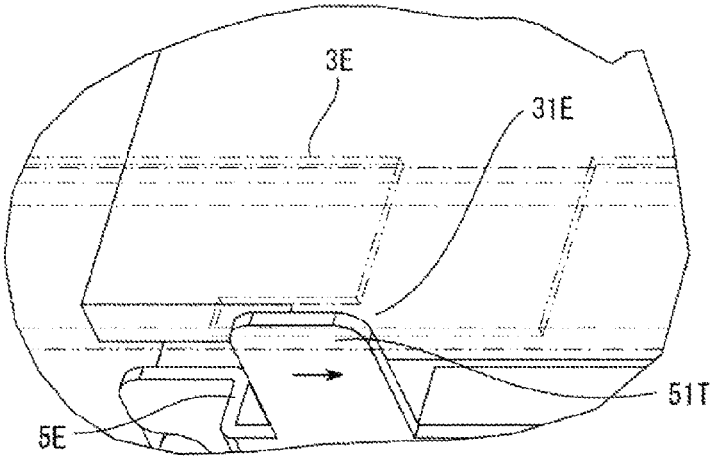
Figure 15A:
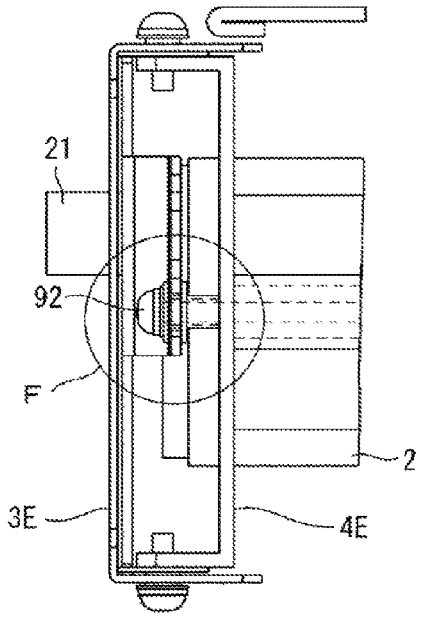
FIGS. 15A, 15B, 15C, and 15D are another views for explaining in detail the essential part of the interlocking mechanism shown in FIGS. 13A and 13B.
Figure 15C:
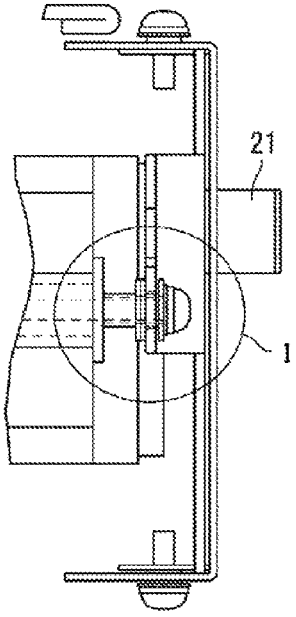
Figure 15B:
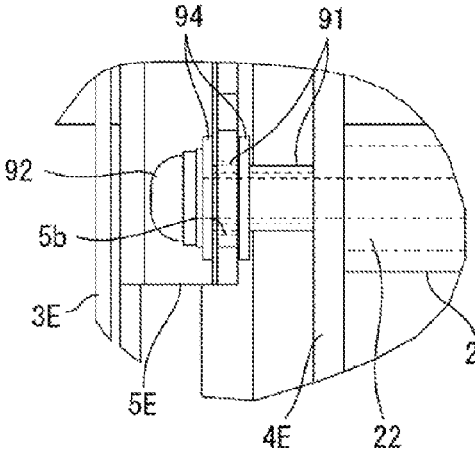
Figure 15D:
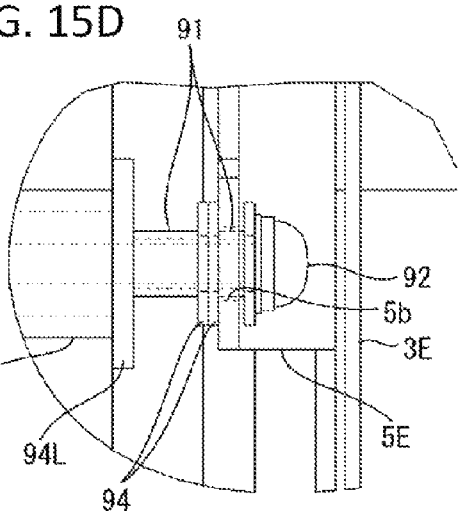

FIGS. 13A and 13B are views for explaining an interlocking mechanism of a protective cover of a panel device according to Embodiment 6 of the present invention; FIG. 13A is a perspective view showing a state of the breaker being ON and the protective cover closing; and FIG. 13B is a perspective view showing a state of the breaker being OFF and the protective cover opening. FIGS. 14A and 14B are views for explaining in more detail the interlocking mechanism shown in FIGS. 13A and 13B; FIG. 14A is a detailed perspective view of the interlocking mechanism; and FIG. 14B is a detailed view of the portion H encircled in FIG. 13A. FIG. 15A is an arrow view taken in the direction S in FIG. 14A; FIG. 15B is a detailed view of the portion F encircled in FIG. 15A; FIG. 15C is an arrow view taken in the direction T in FIG. 14A; and FIG. 15D is a detailed view of the portion I encircled in FIG. 15C. Additionally, Embodiment 6 is, the same as Embodiment 5, an example in which the breakers 2 are arranged in such a way that they are in the ON state when the ON/OFF knob 21 is in the outer side; meanwhile in the OFF state when the knob is in the inner side.

A cover locking member 5E is provided with in its front section the rectangular hole 5*a* that engages with the ON/OFF knob 21, at two locations thereof the elongated holes 5*b* for sliding, and upper and lower portions thereof the locking parts 51T, which are tongue-shaped protrusions. A protective cover 3E is provided with in upper and lower sections thereof engaging parts 31E, which are L-shaped notches, and the round holes 3*d* for turning (not shown in the figure), and in the front section thereof the insertion hole 3*c* for the ON/OFF knob 21 merely to pass therethrough. First, a cover support member 4E is placed on each inner side fixing hole of the fixing holes 22 of the breakers 2 (shown in FIG. 15B), and on which are stacked up the cylindrical spacer 91 and the washer 94. Furthermore, another spacer 91 is placed on that, and this spacer is inserted through one of the elongated holes 5*b* of the cover locking member 5E. At this moment, the ON/OFF knob 21 is also kept inserted through the rectangular hole 5*a* of the cover locking member 5E. After the insertion, the washer 94 is placed and these are collectively fastened by the sems screw 92.

The large washer 94L, which is larger than the washer 94, is place on each outer side fixing hole of the fixing holes 22 of the breakers 2, and on which are stacked up the cylindrical spacer 91 and the washer 94. Furthermore, another spacer 91 is placed on that and this spacer is inserted through the other hole of the elongated holes 5*b* of the cover locking member 5E. After the insertion, the washer 94 is placed and these are collectively fastened by the sems screw 92. By doing in this way, the cover locking member 5E becomes able to slide right and left in conjunction with ON/OFF movement of the ON/OFF knob 21. Next, as shown in FIG. 14A, the spacer 91 (not shown) is inserted through each of the round holes 3*d* (not shown) in the upper and lower sections of the protective cover 3E, furthermore the sems screw 92 (not shown) is inserted through this spacer 91 (not shown), and then these are fastened to the upper and lower screw holes 4*a* of the cover support members 4E. By doing so, the protective cover 3E becomes able to turn. Additionally, configurations, such as the monitoring window, are the same as those of other embodiments.

In Embodiment 6 as configured above, the ON/OFF knob is brought down outward when the breakers 2 are in the ON state, and the cover locking member 5E also slides outward accordingly. When the cover locking member 5E slides outward, the locking parts 51T in the upper and lower portions of the cover locking member 5E are fitted into the upper and lower engaging parts 31E of the protective cover 3E, thereby making the protective cover unable to open. When the breakers 2 are brought into the OFF state, the ON/OFF knob 21 is brought down inward, and the cover locking member 55 slides inward accordingly. When the cover locking member 5E slides inward, the locking parts 51T in the upper and lower portions of the cover locking member 5E are released from the upper and lower engaging parts 31E of the protective cover 3E, thereby enabling the protective cover to open. Then, when the protective cover 3E is pulled frontward, the protective cover 3E opens.

If the breakers 2 are mistakenly turned on when the protective cover 3E is in the open state and then the protective cover 3E is intended to be closed in this state, the ON/OFF knob 21 is brought down outward when the breakers 2 are in the ON state, and accordingly the cover locking member 5E comes into the state of sliding outward at the same time. If the protective cover 3E is intended to be closed in this state, the locking parts 51T provided at the two locations in the upper and lower portions of the cover locking member 5E are brought into a state of not engaging with the engaging parts 31E provided at the two locations in the upper and lower sections of the protective cover 3E, thereby making the protective cover 3E unable to close.

According to Embodiment 6 as described above, opening/closing conditions of the protective cover 3 can be set by only the movement of the ON/OFF knob 21; the protective cover 3E cannot be opened when the breakers 2 are in the ON state, but can be opened only when the breakers 2 are in the OFF state. Since the interlocking mechanism for the protective cover 3E provided on each of the breakers 2 can be released breaker by breaker, maintenance can be carried out in safe, the configuration of the device becomes simple, the number of parts can be decreased, and regular standardized parts can be used for the breakers 2, so that the same effects as those of Embodiment 1, such as providing breakers at low cost, can be produced.

Embodiment 7

Figure 16A:
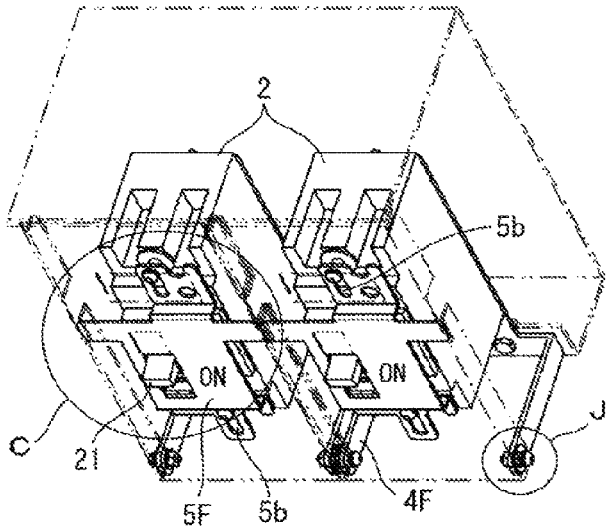
FIGS. 16A, 16B, and 16C are views for explaining an interlocking mechanism of a protective cover of a panel device according to Embodiment 7 of the present invention.
Figure 16C:
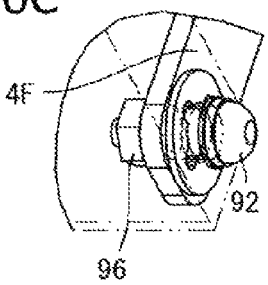
Figure 16B:
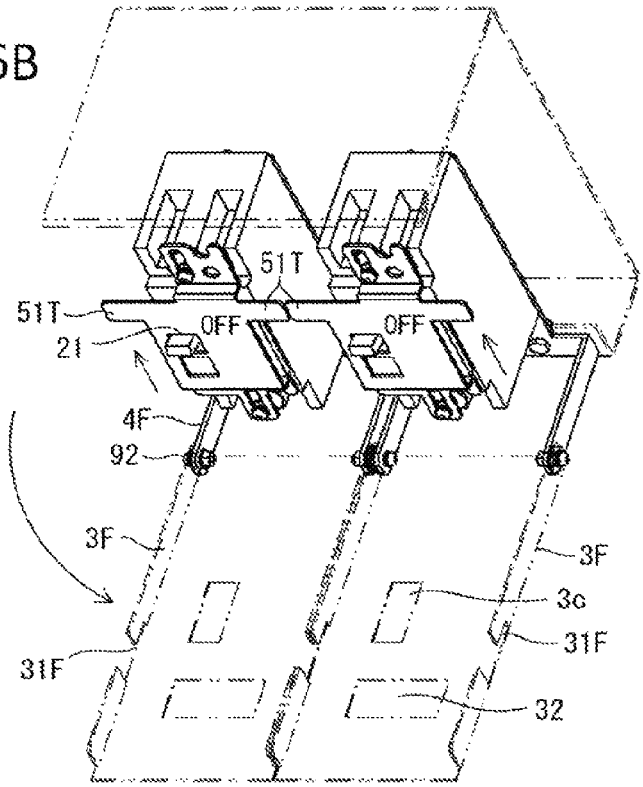
Figure 17A:
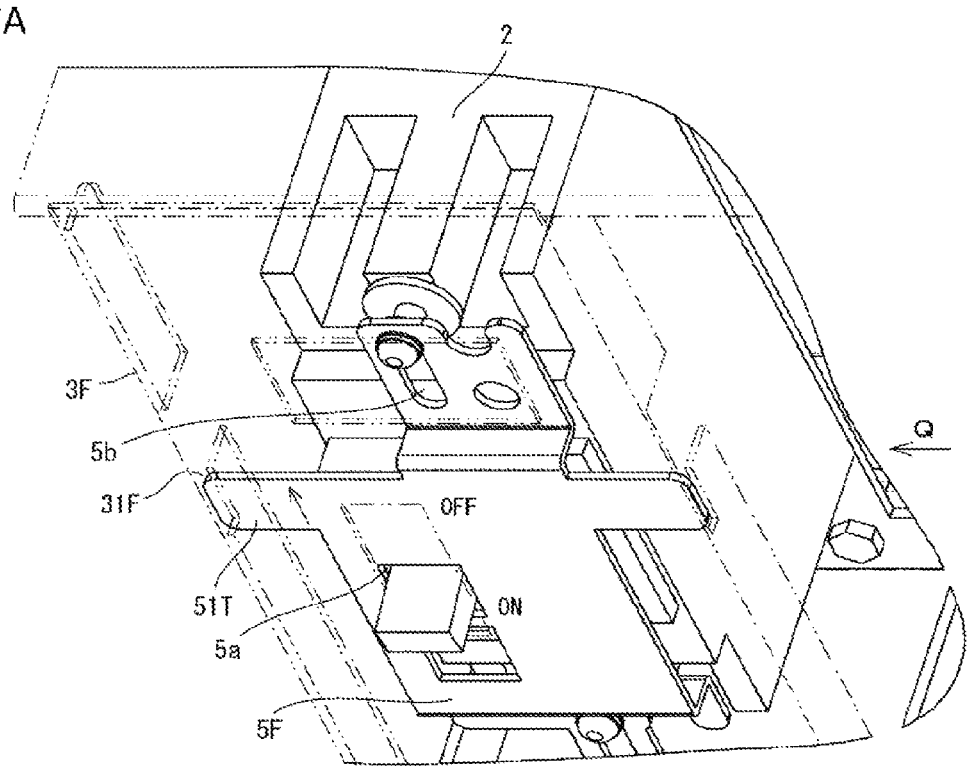
FIGS. 17A and 17B are views for explaining in detail the essential part of the interlocking mechanism shown in FIGS. 16A, 16B, and 16C.
Figure 17B:
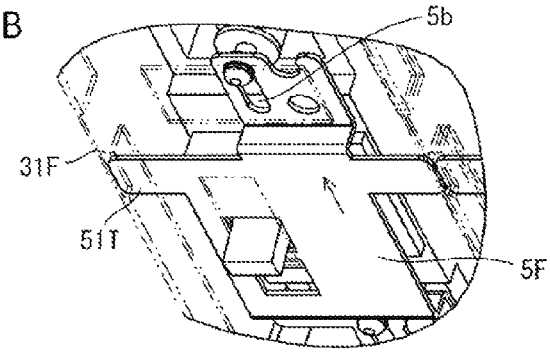
Figure 18A:
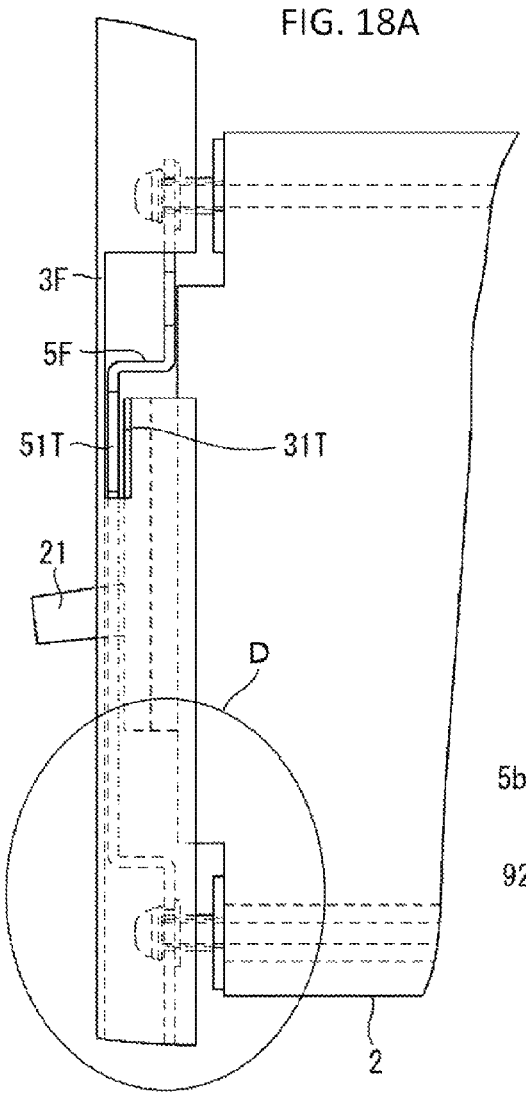
FIGS. 18A and 18B are another views for explaining in detail the essential part of the interlocking mechanism shown in FIGS. 16A, 16B, and 16C.
Figure 18B:
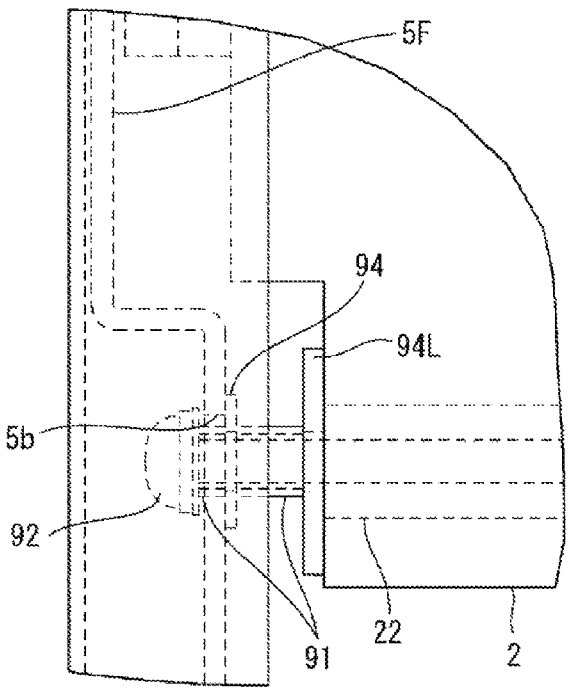

FIGS. 16A, 16B, and 16C are views for explaining an interlocking mechanism of a protective cover of a panel device according to Embodiment 7 of the present invention; FIG. 16A is a perspective view showing a state of the breaker being ON and the protective cover closing; FIG. 16B is a perspective view showing a state of the breaker being OFF and the protective cover opening; and FIG. 16C is a detailed view of the portion J encircled in FIG. 16A. FIGS. 17A and 17B are views for explaining in more detail the interlocking mechanism shown in FIGS. 16A, 16B, and 16C; FIG. 17A is a detailed perspective view of the interlocking mechanism; and FIG. 17B is a detailed view of the portion C encircled in FIG. 16A. FIG. 18A is an arrow view of the essential part taken from the direction Q in FIG. 17A; FIG. 18B is a detailed view of the portion D encircled in FIG. 18A. Additionally, Embodiment 7 is an example in which the breakers 2 are placed in portrait orientation and arranged right and left; the breakers are turned on when the ON/OFF knob 21 is brought down downward; meanwhile turned off when the knob is brought down upward; and a cover locking member 5F slides in the up and down directions in conjunction with the ON/OFF knob 21. When the breakers 2 are in the ON state, the tongue-shaped locking parts 51T protruding right and left of the cover locking member 5F are fitted into engaging parts 31F, which are L-shaped notches formed in right and left sections of a protective cover 3F, thereby making the protective cover 3F unable to open.

The cover locking member 5F is provided with in the front section thereof the rectangular hole 5*a* that engages with the ON/OFF knob 21, at two locations thereof the elongated holes 5*b* for sliding, and in the right and left portions thereof the tongue-shaped locking parts 51T that are fitted into the engaging parts 31F of the protective cover 3F. On the other hand, the protective cover 3F is provided with in the front section thereof the insertion hole 3*c* through which the ON/OFF knob merely passes, and in the right and left sections thereof the engaging parts 31F into which the locking parts 51T of the cover locking member 5F are fitted and the round holes 3*d* (not shown) for the protective cover 3F to turn. In addition, the round holes 4*e* (not shown) for turnably fixing the protective cover 3F are made in right and left sections of a cover support member 4F. Additionally, configurations, such as the monitoring window, are the same as those of other embodiments.

In assembling, the large washer 94L is placed at first on each of the fixing holes 22 of the breakers 2 (shown in FIG. 18B), and on which are stacked up the spacer 91 and the washer 94. Furthermore, another spacer 91 is placed on that, and this spacer 91 is inserted through each of the elongated holes 5*b* of the cover locking member 5F, and at the same time, the ON/OFF knob 21 is also inserted through the rectangular hole 5*a* of the cover locking member 5F. Then, these are collectively fixed by the sems screw 92. Thereby, the cover locking member 5F becomes able to slide up and down in conjunction with ON/OFF movement of the ON/OFF knob 21. Next as shown in FIGS. 16A, 16B, and 16C, the spacer 91 (not shown) is inserted at the same time through each of the round holes 3*d* (not shown) in the right and left sides of the protective cover 3F and the round holes 4*e* (not shown) for fixing the protective cover 3F in the right and left sides of the cover support member 4F, and these are fixed by the sems screw 92 and the nut 96. By doing in this way, the protective cover 3F becomes able to turn from the upper side toward the lower side of the breakers 2.

In Embodiment 7 as configured above, the ON/OFF knob is brought down downward when the breakers are in the ON state, and the cover locking member 5E also slides downward accordingly. When the cover locking member 5F slides downward, the locking parts 51T provided in the right and left sides of the cover locking member 5F are fitted into the engaging parts 31F provided in the right and left sides of the protective cover 3F, thereby making the protective cover 3F unable to open. When the breakers 2 are brought into the OFF state, the ON/OFF knob 21 is brought down upward, and the cover locking member 5F also slides upward accordingly. When the cover locking member 5F slides upward, the locking parts 51T of the cover locking member 5F are released from the engaging parts 31F of the protective cover 3F, and the protective cover 3F thereby becomes able to open. When the protective cover is pulled frontward, the protective cover 3F opens.

If the breakers 2 are mistakenly turned on when the protective cover 3F is in the open state and then the protective cover 3F is intended to be closed in this state, the ON/OFF knob 21 is brought down downward when the breakers 2 are in the ON state, and accordingly the cover locking member 5F comes into the state of sliding downward at the same time. If the protective cover 3F is intended to be closed in this state, the locking parts 51T provided at the two locations in the right and left sides of the cover locking member 5F are brought into a state of not engaging with the engaging parts 31F provided at the two locations in the right and left sections of the protective cover 3F, thereby making the protective cover 3F unable to close.

According to Embodiment 7 as described above, opening/closing conditions of the protective cover 3F can be set by only the ON/OFF movement of the ON/OFF knob 21; the protective cover 3F cannot be opened when the breakers 2 are in the ON state, but can be opened only when the breakers 2 are in the OFF state. Since the interlocking mechanism for the protective cover 3F provided on each of the breakers 2 can be released breaker by breaker, maintenance can be carried out in safe, the configuration of the device becomes simple, the number of parts can be decreased, and regular standardized parts can be used for the breakers 2, thereby producing the same effects as those in Embodiment 1, such as enabling the provided breakers to be provided at low cost.

Embodiment 8

Figure 19A:
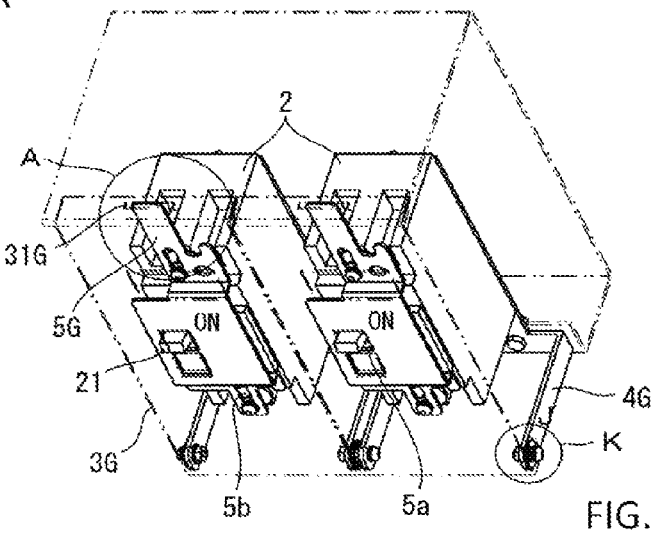
FIGS. 19A, 19B, and 19C are views for explaining an interlocking mechanism of a protective cover of a panel device according to Embodiment 8 of the present invention.
Figure 19B:
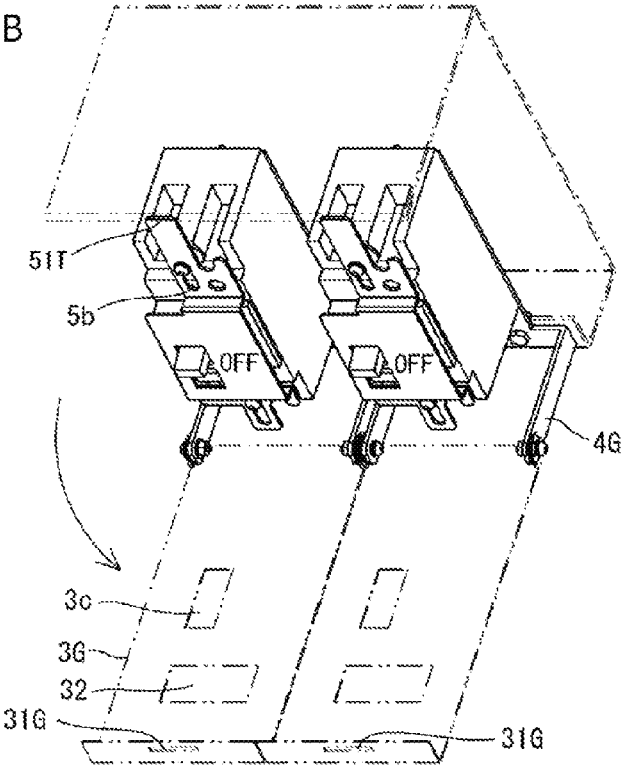
Figure 19C:
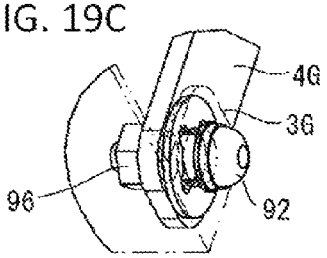
Figure 20A:
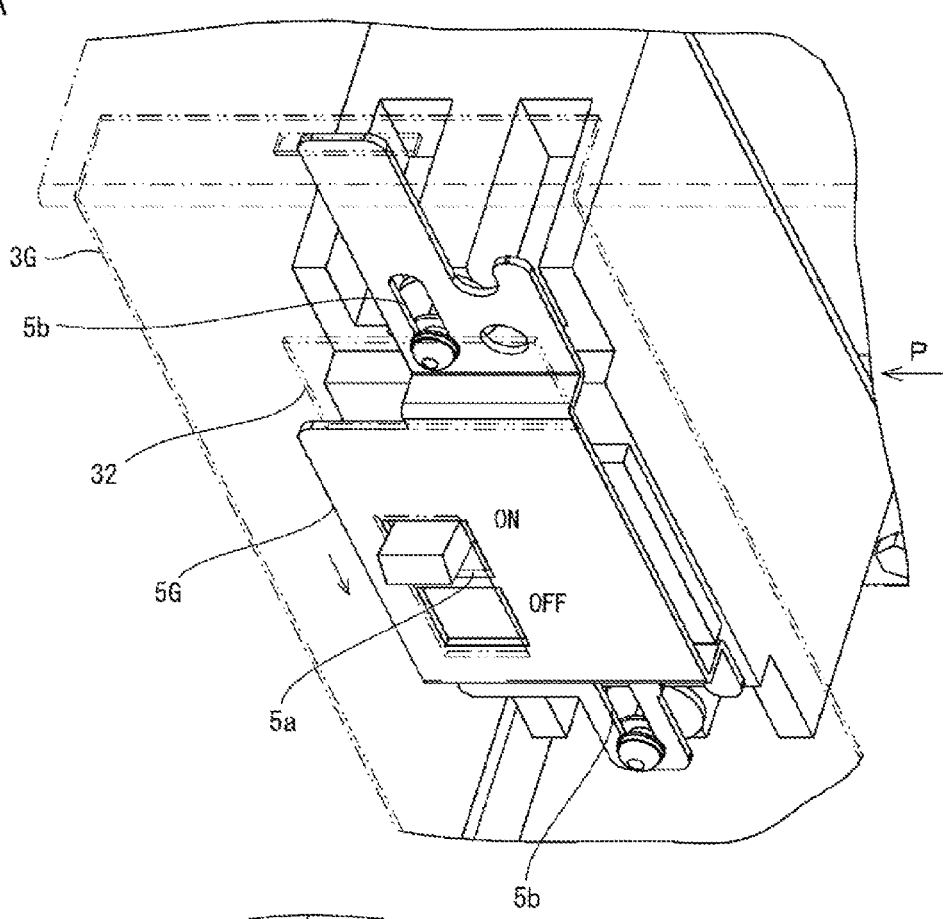
FIGS. 20A and 20B are views for explaining in detail the essential part of the interlocking mechanism shown in FIGS. 19A, 19B, and 19C.
Figure 20B:
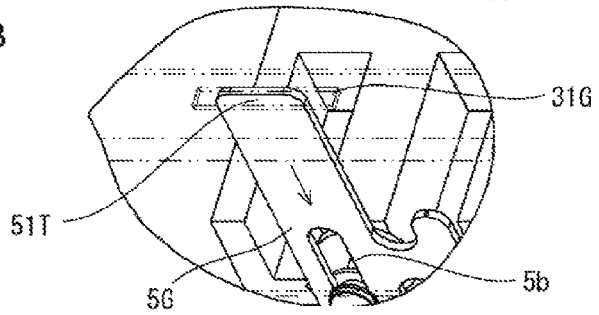
Figure 21A:
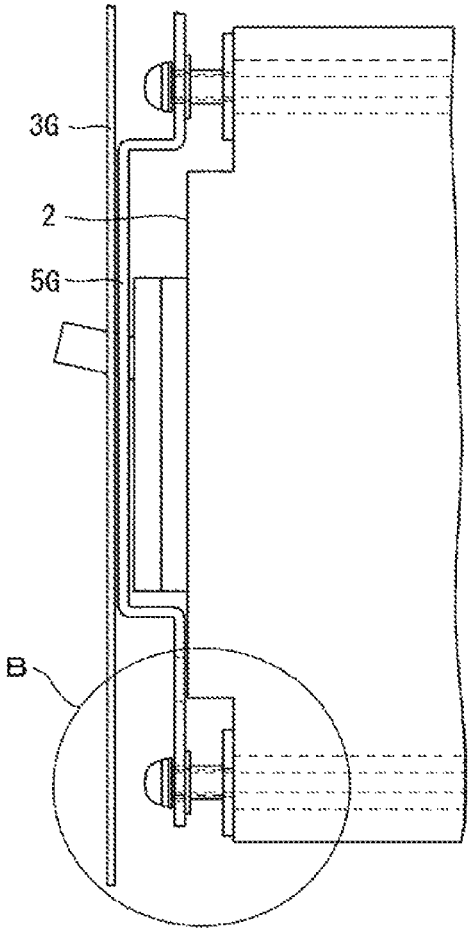
FIGS. 21A and 21B are another views for explaining in detail the essential part of the interlocking mechanism shown in FIGS. 19A, 19B, and 19C.
Figure 21B:
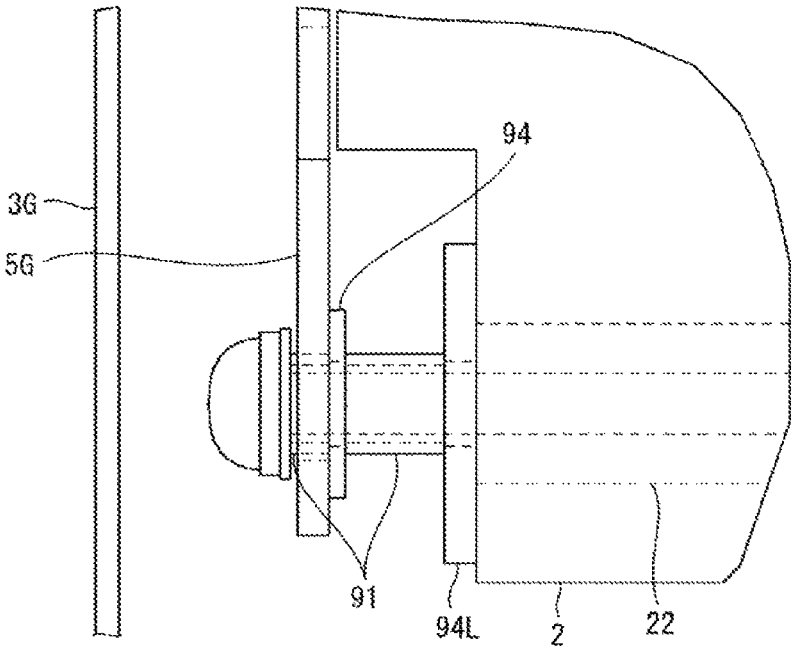

FIGS. 19A, 19B, and 19C are views for explaining an interlocking mechanism of a protective cover of a panel device according to Embodiment 8 of the present invention; FIG. 19A is a perspective view showing a state of the breaker being ON and the protective cover closing; FIG. 19B is a perspective view showing a state of the breaker being OFF and the protective cover opening; and FIG. 19C is a detailed view of the portion K encircled in FIG. 19A. FIGS. 20A and 20B are views for explaining in more detail the interlocking mechanism shown in FIGS. 19A, 19B, and 19C; FIG. 20A is a detailed perspective view of the interlocking mechanism; and FIG. 20B is a detailed view of the portion A encircled in FIG. 19A. FIG. 21A is an arrow view of the essential part taken from the direction P in FIG. 20A; FIG. 21B is a detailed view of the portion B encircled in FIG. 21A. Additionally, Embodiment 8 represents an interlocking mechanism in which the breakers 2, the same as Embodiment 7, are placed in portrait orientation and arranged right and left; however, this is an example in which the breakers 2 are arranged such that the ON/OFF directions of the breakers are reversed, so the ON/OFF knob 21 is brought down upward when the breakers are in the ON state and the knob is brought down downward when in the OFF state. A cover locking member 5G is made to move in conjunction with the ON/OFF knob 21; when the breakers 2 are in the ON state, a locking part 51T, which is a tongue-shaped protrusion projecting upward of the cover locking member 5G, is fitted into an engaging part 31G, which is a slit hole provided in the upper side of a protective cover 3G, thereby making the protective cover 3G unable to open.

In the front section of the cover locking member 5G are provided the rectangular hole 5*a* that engages with the ON/OFF knob 21 and the elongated holes 5*b* that slidably support the cover locking member 5G at two locations, and in the upper side thereof is provided the locking part 51T that is fitted into the engaging part 31G of the protective cover 3G. In the protective cover 3G are provided in the front section thereof the insertion hole 3*c* through which the ON/OFF knob merely passes, in the upper side thereof the engaging part 31G into which the locking part 51T of the cover locking member 5G is fitted, and in right and left sections thereof round holes 3*d* (not shown) for the protective cover 3G to turn. The round holes 4*e* (not shown) for fixing the protective cover 3G are provided in right and left sections of a cover support member 4G.

Additionally, structures enabling the cover locking member 5G to slide up and down with respect to the breakers 2 in conjunction with ON/OFF movement of the ON/OFF knob 21 and the protective cover 3G to turn from the upper side toward the lower side of the breakers 2 are the same as those in Embodiment 7, so their explanation will be omitted. Additionally, the difference other than the above between Embodiments 8 and 7 is whether the locking parts 51T project in the right and left directions or the locking part 51T projects in the upward direction, and whether the engaging part 31G is formed of an L-shaped notch or of a slit hole in a bent section formed in the back side of the upper end face of the protective cover 3G.

In Embodiment 8 as configured above, the ON/OFF knob is brought down upward when the breakers 2 are in the ON state, and the cover locking member 5G also slides upward accordingly. When the cover locking member 5G slides upward, the locking part 51T provided in the upper side of the cover locking member 5G is fitted into the engaging part 31G provided in the upper side of the protective cover 3G, thereby making the protective cover 3G unable to open. When the breakers 2 are brought into the OFF state, the ON/OFF knob 21 is brought down downward, and the cover locking member 5G also slides downward accordingly. When the cover locking member 5G slides downward, the locking part 51T of the cover locking member 5G is released from the engaging part 31G of the protective cover 3G, thereby making the protective cover 3G ready to open. Then, when the protective cover 3E is pulled frontward, the protective cover 3G opens.

If the breakers 2 are mistakenly turned on when the protective cover 3G is in the open state and then the protective cover 3G is intended to be closed in this state, the ON/OFF knob 21 is brought down upward when the breakers 2 are in the ON state, and accordingly the cover locking member 5G slides upward at the same time. If the protective cover 3G is intended to be closed in this state, the bent section in which the engaging part 31G of the protective cover 3G is provided interferes with the locking part 51T of the cover locking member 5G that has slid upward, thereby making the protective cover 3G unable to close.

According to Embodiment 8 as described above, opening/closing conditions of the protective cover 3 can be set by only the ON/OFF movement of the ON/OFF knob 21; the protective cover 3G cannot be opened when the breakers 2 are in the ON state, but can be opened only when the breakers 2 are in the OFF state. Since the interlocking mechanism for the protective cover 3G provided on each of the breakers 2 can be released breaker by breaker, maintenance can be carried out in safe, the configuration of the device becomes simple, the number of parts can be decreased, and regular standardized parts can be used for the breakers 2, thereby producing the same effects as those in Embodiment 1, such as providing breakers at low cost.

As described above, in each embodiment exemplifying a panel device related to the present invention, the interlocking mechanism for the protective cover 3 is configured in such a way that any one of the protective cover 3, the cover support member 4 and the cover locking member 5 is slidably provided, in conjunction with the movement of the ON/OFF knob 21, in parallel to the moving directions of the ON/OFF knob 21, and in each of the foregoing cases, the engaging parts 31 of the protective cover 3 are locked by the cover locking member 5 when the ON/OFF knob 21 is in the turned-on position, thereby making the cover unable to open. In this connection, the device is configured as follows: the protective covers 3 and 3C are made to slide in Embodiments 1 and 4, respectively, the cover support member 4B is made to slide in Embodiment 2, and the cover locking members 5B and 5D to 5G are made to slide in Embodiment 3 and Embodiments 5 to 8, respectively. The interlocking mechanism for the protective cover is provided for each breaker in all of the above cases, whereby danger of touching live parts of other breakers can be avoided, so that maintenance can be carried out in safe. Moreover, not only the configuration of the device becomes simple and the number of parts can be decreased, but also a remarkable effect of coping with various breaker layouts can be produced.

Additionally, it is possible without departing from the scope and spirit of this invention for those skilled in the art to freely combine part of or the whole of each embodiment, or amend or delete each embodiment as needed. For example, it goes without saying that the type and the shape of screws, such as the sems screw 92 and the screw 97, materials for these screws, and how to fix these screws can be altered as needed. Explanations have been made on cases of the panel device being a breaker panel; however, the device will be preferably applied to panels such as control panels. Moreover, the breakers 2 are not necessarily arranged in a pair, and in addition, it goes without saying that the breakers can be operated independently of each other even when they are paired and arranged right and left. Furthermore, alterations, such as interchanging the shape of the engaging parts 31 (31B to 31F) with that of the locking parts 51 (51T, 51S), will be possible.

DESCRIPTION OF THE REFERENCE NUMERALS

1: breaker panel
11: housing
11*a*: opening/closing door
2: breakers
21: ON/OFF knob
22: fixing holes
3, 3A, 3B, 3C, 3D, 3E, 3F, 3G: protective cover
3*a*; elongated holes
3*b*: round holes (for circling screw)
3*c*: insertion hole
3*d*: round holes (for turning)
31, 31B, 31C, 31D, 31E, 31F, 31G: engaging part/engaging parts
32: monitoring window
4, 4A, 4C, 4E, 4F, 4G: cover support member
4B1: cover support member
4B2: cover support member

4*a*: screw hole/screw holes
4*b*: grooves
4*c*: rectangular hole
4*d*: elongated holes
4*e*: round hole/round holes
5, 5B, 5C, 5D, 5E, 5F, 5G: cover locking member
5*a*: rectangular hole
5*b*: elongated holes
51: locking parts (groove)
51T: locking part/locking parts (tongue-shaped protrusion)
51S: locking part (slit)
51*a*; straight section
51*b*: arc section
91: spacer
92, 92*a*, 92O: sems screw
93: nylon washer
94: washer
94L: large washer
96: nut
97: screw

The invention claimed is:

1. A panel device, comprising:

a protective cover including a front face that has an insertion hole for an ON/OFF knob of a molded case circuit breaker, the protective cover formed to cover an exposed live part of the molded case circuit breaker and provided with an engaging part at a predetermined portion thereof;

a cover support member that openably and closably supports the protective cover; and a cover locking member that engages with and physically contacts the engaging part when the protective cover is closed, so as to restrict turning of the protective cover, and the cover locking member is released from physical contact with the engaging part when the protective cover is opened; wherein either one of the protective cover and the cover support member is movably provided in conjunction with movement of the ON/OFF knob, and the engaging part and the cover locking member are engaged with each other or released from each other by the movement of either one of the cover support member and the ON/OFF knob.

2. A panel device according to claim 1, wherein any one of the protective cover, the cover support member and the cover locking member is movably provided in conjunction with the movement of the ON/OFF knob via the insertion hole for the ON/OFF knob.

3. A panel device according to claim 1, wherein a monitoring window enabling visual inspection of the live part is provided in the protective cover.

4. A panel device according to claim 1, wherein in a state of the ON/OFF knob being turned on when the protective cover is in an open state, the protective cover interferes with the cover locking member or the ON/OFF knob, thereby making the protective cover unable to close.

5. A panel device according to claim 1, wherein the protective cover is slidably supported in parallel to a moving direction of the ON/OFF knob with respect to the cover support member, the length of the insertion hole along the moving direction is made the same as a moving range of the ON/OFF knob, one end portion of the insertion hole interferes with the ON/OFF knob when the ON/OFF knob is at a turned-on position so as to restrict the sliding and also the engagement between the engaging part and the cover locking member is maintained, the protective cover becomes slidable toward a turned-off position of the ON/OFF knob when the ON/OFF knob is at the turned-off position, and the engaging part can be released from the cover locking member at a position of the protective cover being slid.

6. A panel device according to claim 1, wherein the cover support member is slidably provided in conjunction with the ON/OFF knob, in parallel to a moving direction of the ON/OFF knob, and turnably supports the protective cover at a predetermined portion thereof.

7. A panel device according to claim 1, wherein the protective cover is slidably supported in parallel to a moving direction of the ON/OFF knob with respect to the cover support member provided near the molded case circuit breaker and also turnably supported at any sliding position; the engaging part is formed of an engaging pin erected on the protective cover at a radially predetermined distance from the turning central axis; the cover locking member is formed of a sheet guide member provided with a guide groove that includes a straight section that is parallel to the sliding direction and has the same length as the sliding distance and an arc section that continuously connects to the straight section, and engages with the engaging pin; and when the ON/OFF knob is turned on, the engaging pin is located in the straight section of the guide groove, thereby restricting movement of the protective cover in an opening direction.

8. A panel device according to claim 1, wherein the cover locking member is slidably provided in conjunction with the ON/OFF knob, in parallel to a moving direction of the ON/OFF knob, and a locking part that can engage with the engaging part is formed at a predetermined portion thereof.

9. A panel device according to claim 8, wherein one of the engaging part and the locking part is formed of a tongue-shaped protrusion and the other is formed of a notch or a hole that receives the protrusion.

10. A panel device, comprising:

a protective cover that has an insertion hole for an ON/OFF knob of a molded case circuit breaker and is formed to cover an exposed live part of the molded case circuit breaker and provided with an engaging part at a predetermined portion thereof;

a cover support member that openably and closably supports the protective cover; and a cover locking member that engages with and physically contacts the engaging part when the protective cover is closed, so as to restrict turning of the protective cover, and the cover locking member is released from physical contact with the engaging part when the protective cover is opened; wherein the cover locking member is movably provided in conjunction with movement of the ON/OFF knob, the engaging part and the cover locking member are engaged with each other or released from each other by the movement of the cover locking member, and the protective cover is opened and closed as turnably supported by the cover support member.

* * * * *